US009644867B2

(12) United States Patent
Xu

(10) Patent No.: US 9,644,867 B2
(45) Date of Patent: May 9, 2017

(54) ROTARY VALVE AND A PULSE TUBE REFRIGERATOR USING A ROTARY VALVE

(75) Inventor: Mingyao Xu, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 1315 days.

(21) Appl. No.: 12/909,882

(22) Filed: Oct. 22, 2010

(65) Prior Publication Data

US 2011/0094244 A1 Apr. 28, 2011

(30) Foreign Application Priority Data

Oct. 27, 2009 (JP) ..... 2009-247060
Oct. 27, 2009 (JP) ..... 2009-247061

(51) Int. Cl.
*F25B 9/00* (2006.01)
*F16K 31/02* (2006.01)
*F25B 9/14* (2006.01)

(52) U.S. Cl.
CPC .... *F25B 9/145* (2013.01); *F25B 2309/14181* (2013.01)

(58) Field of Classification Search
CPC .... F25B 2309/1418; F25B 2309/14181; F25B 2309/006; F25B 2309/1411; F25B 2309/1427
USPC ..... 62/6
See application file for complete search history.

(56) References Cited

U.S. PATENT DOCUMENTS 1,515,165 A * 11/1924 Oswald ..... F25D 11/022 62/517
1,987,105 A * 1/1935 Hall ..... F01L 7/028 123/190.15
2,474,950 A * 7/1949 MacChesney ..... A63B 47/007 294/187
2,646,754 A * 7/1953 Overbeke ..... F01B 1/0672 285/918

(Continued)

FOREIGN PATENT DOCUMENTS

JP 09-033124 2/1997
JP 09-296963 11/1997

(Continued)

OTHER PUBLICATIONS

U.K. Combined Search and Examination Report mailed Jan. 31, 2011.

*Primary Examiner* — Len Tran
*Assistant Examiner* — Kirstin Oswald
(74) *Attorney, Agent, or Firm* — IPUSA, PLLC

(57) ABSTRACT

A rotary valve of a multivalve type pulse tube refrigerator includes: a stationary seat; a rotary disk to change a coolant path by rotating while surface-contacting with a face of the stationary seat; a plurality of first ports provided in the face of the stationary seat to supply a high-pressure coolant to a regenerator and exhaust a low-pressure coolant from the regenerator; and a plurality of second ports provided in the face of the stationary seat to supply a high-pressure coolant to a pulse tube and exhaust a low-pressure coolant from the pulse tube. The first ports are arranged in a first circular track area in rotation symmetry with respect to the center of the face. The second ports are arranged in a second circular track area in rotation symmetry with respect to the center of the face.

16 Claims, 18 Drawing Sheets

(56) References Cited

U.S. PATENT DOCUMENTS 2,988,080 A * 6/1961 Rankl ..... F01L 3/06 123/188.2
3,177,899 A * 4/1965 Anderson ..... F16K 11/072 137/625.29
3,698,182 A * 10/1972 Knoos ..... F02G 1/044 60/522
4,926,639 A * 5/1990 Mitchell ..... F01B 3/0079 60/517
4,987,743 A * 1/1991 Lobb ..... F01L 33/02 60/520
5,191,773 A * 3/1993 Cassell ..... F25D 17/02 62/342
5,481,878 A * 1/1996 Shaowei ..... F25B 9/145 60/520
5,482,919 A * 1/1996 Joshi ..... F25B 9/14 310/52
5,647,218 A * 7/1997 Kuriyama ..... F25B 9/14 62/175
5,647,219 A * 7/1997 Rattray ..... F25B 9/145 62/6
5,701,743 A * 12/1997 Hagiwara ..... F25B 9/145 60/517
5,711,156 A * 1/1998 Matsui ..... F25B 9/145 62/467
5,711,157 A * 1/1998 Ohtani ..... F25B 9/10 62/467
5,878,580 A * 3/1999 Schilling ..... F25B 9/14 62/467
6,460,349 B1 * 10/2002 Kawano ..... F16K 11/074 251/129.11
7,549,295 B2 * 6/2009 Gao ..... F25B 9/10 137/625.46
2003/0089116 A1 * 5/2003 Heron ..... F16K 3/188 62/6
2004/0040315 A1 * 3/2004 Koyama ..... F16K 11/076 62/6
2005/0115247 A1 * 6/2005 Gao ..... F25B 9/145 62/6
2008/0245077 A1 10/2008 Xu et al.
2008/0295525 A1 * 12/2008 Xu ..... F16K 31/041 62/6
2009/0151803 A1 * 6/2009 Longsworth ..... F16K 31/041 137/630.21

FOREIGN PATENT DOCUMENTS

JP 2007-522431 8/2007
WO WO2005/078363 8/2005
WO 2006135364 * 12/2006 ..... F16K 31/041

* cited by examiner

ROTARY VALVE AND A PULSE TUBE REFRIGERATOR USING A ROTARY VALVE

TECHNICAL FIELD

The present invention relates to a rotary valve of a pulse tube refrigerator and, more particularly, to a rotary valve of a multivalve-type pulse tube refrigerator.

BACKGROUND ART

Generally, a pulse tube refrigerator is used as a cooling device, which is built into an apparatus requiring an extremely-low temperature such as, for example, a nuclear magnetic resonance diagnostic apparatus (MRI), etc.

In a pulse tube refrigerator, an operation of causing a coolant gas (for example, helium gas), which is an operating fluid compressed by a compressor, to flow into a pulse tube and an operation of causing the operating fluid to flow out of the pulse tube and a regenerator regenerator and collecting the operating fluid are performed. By repeating these operations alternately, low-temperature ends of the regenerator and the pulse tube can be at an extremely-low temperature. A cooling object is cooled by bringing the cooling object into thermal contact with the low-temperature ends.

From among pulse tube refrigerators, especially a multivalve-type pulse tube refrigerator has a high cooling efficiency and application in various fields is expected.

In a multivalve-type pulse tube refrigerator, a coolant gas is caused to flow to an appropriate part and in an appropriate direction at a predetermined timing. In order to do so, a plurality of valves must be mutually related and the valves must be opened and closed at predetermined timings. For example, PCT Japanese Translation Patent Publication No. 2007-522431 discloses a rotary valve used as a member integrating a plurality of valve functions.

The rotary valve includes a rotatable rotary disk and a seat, which is stationary. A plurality of holes (grooves), which are communicated with a high-pressure side and a low-pressure side of a compressor, are opened in a generally circular flat surface (face) of the rotary disk. Additionally, a plurality of ports, which are communicated with a regenerator and a pulse tube, are opened in a generally circular flat surface (face) of the stationary seat. Accordingly, when the rotary disk is rotated while pressing the face of the stationary seat onto the face of the rotary disk, and when the relative positions of the faces (more specifically, relative positions of the holes and the ports) are set in a first predetermined positional relationship, a supply flow path of a high-pressure coolant gas is formed from the compressor to the regenerator and/or the pulse tube. On the other hand, when the relative positions of the faces (more specifically, relative positions of the holes and the ports) are set in a second predetermined positional relationship, an exhaust flow path of a low-pressure coolant gas from the regenerator and/or the pulse tube to the compressor. As mentioned above, the rotary valve can alternately change the flow path of the coolant gas by rotating the rotary disk.

In a generally used rotary valve such as disclosed in the above-mentioned PCT Japanese Translation Patent Publication No. 2007-522431, a plurality of first ports, a second port, a third port, a fourth port and a fifth port are provided in the face of the stationary seat. The first ports are used to introduce a high-pressure coolant gas into the regenerator. The second port is used to introduce the high-pressure coolant gas into a first stage pulse tube. The third port is used to exhaust a low-temperature coolant gas from the first stage pulse tube. The fourth port is used to introduce a high-pressure coolant gas into a second stage pulse tube. The fifth port is used to exhaust a low-pressure coolant gas from the second stage pulse tube. The first ports are positioned along a first circumference (track) equidistant (that is, a radius) from the center of the face of the stationary seat. The second port and the fourth port are positioned on a second circumference (track) equidistant (that is, a radius) from the center of the face of the stationary seat. The third port and the fifth port are positioned on a third circumference (track) equidistant (that is, a radius) from the center of the face of the stationary seat.

In other words, the face of the stationary seat must have three different circumferences for the first port, for the second and fourth ports and for the third and fifth ports. For example, the length of the first port for the regenerator (an overall length in a radial direction of the face) is about 10 mm, and the distance (radius) of the first track from the center of the face is about 20 mm.

However, according to the above-mentioned structure, it is difficult to reduce the diameter of the face of the stationary seat to a diameter smaller than a diameter which can include the three tracks. Thus, the diameter of the faces of the stationary seat and the rotary disk are necessarily large, thereby increasing a size of the rotary valve. If the size of the rotary valve is large, a position of the rotary valve in the pulse tube refrigerator is limited, and a torque needed to rotate the rotary disk is increased. Moreover, if the rotary valve is large, an amount of abrasion generated due to wear of the faces is increased.

SUMMARY OF THE INVENTION

There is provided according to an aspect of the present invention a rotary valve used for a multivalve type pulse tube refrigerator having at least one pulse tube and one regenerator, the rotary valve including: a stationary seat having a face; a rotary disk configured to change a coolant path by rotating while surface-contacting with the face of the stationary seat; a plurality of first ports provided in the face of the stationary seat in order to supply a high-pressure coolant to the regenerator and exhaust a low-pressure coolant from the regenerator; and a plurality of second ports provided in the face of the stationary seat in order to supply a high-pressure coolant to the pulse tube and exhaust a low-pressure coolant from the pulse tube, wherein all of the first ports are arranged in a first circular track area having a first radius from a center of the face of the stationary seat in rotation symmetry with respect to the center of the face of the stationary seat, and all of the second ports are arranged in a second circular track area having a second radius from the center of the face of the stationary seat in rotation symmetry with respect to the center of the face of the stationary seat.

According to the above-mentioned invention, a rotary valve can be miniaturized, and a small multivalve type pulse tube refrigerator having such a downsized rotary valve can be provided.

Other objects, features and advantages of the present invention will become more apparent from the following detailed description when read in conjunction with the accompanying drawings.

DETAILED DESCRIPTION OF THE PREFERRED EMBODIMENTS

It is a general object of the present invention to provide a novel and useful rotary valve in which the above-mentioned problems are eliminated.

A more specific object of the present invention is to provide a downsized rotary valve and a multivalve type pulse tube refrigerator having such a downsized rotary valve.

A description will be given below, with reference to the drawings, of embodiments according to the present invention.

A description will be given first, with reference to FIG. 1, of a typical four-valve type pulse tube refrigerator.

Figure 1:
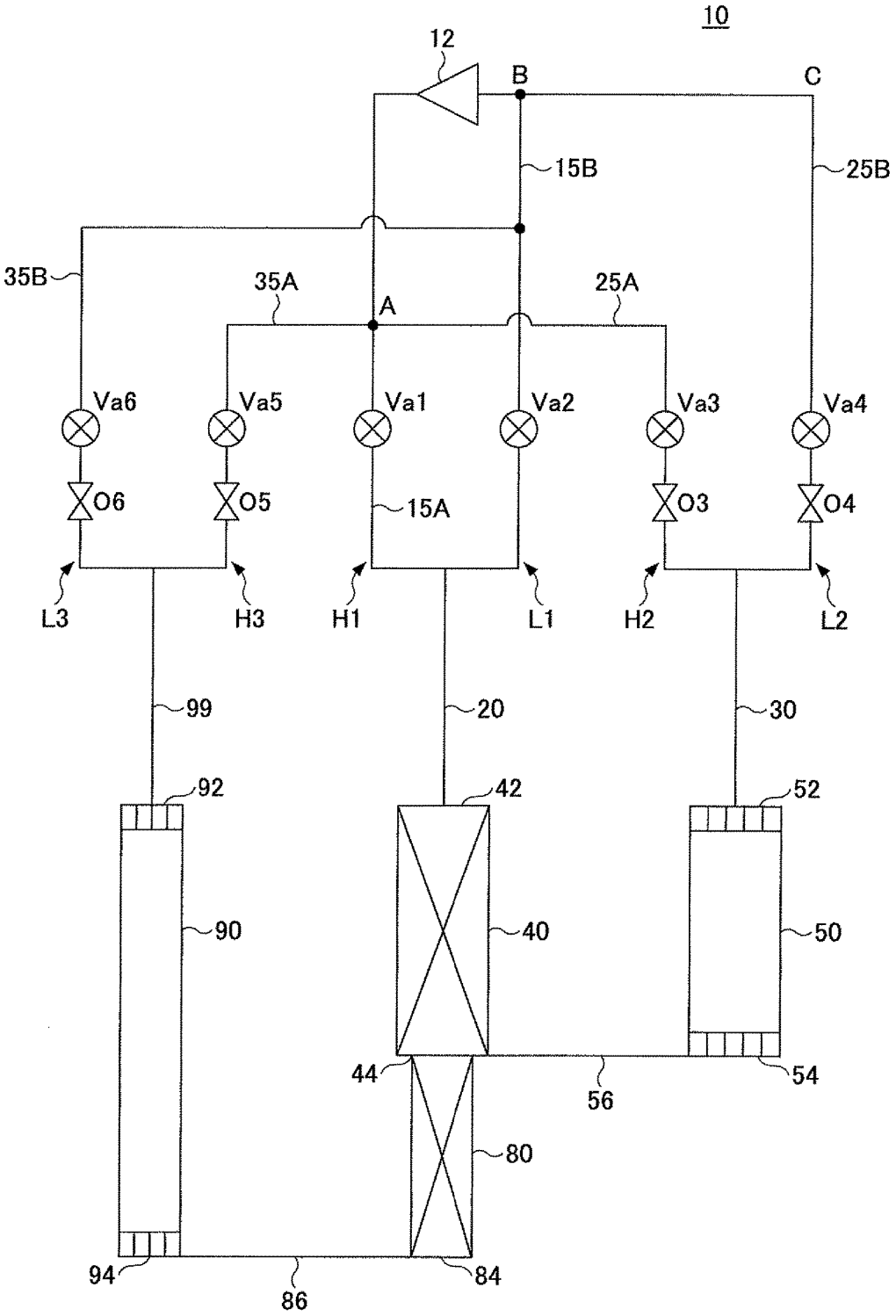
FIG. 1 is an outline structure diagram of a two-stage four-valve type pulse tube refrigerator.

FIG. 1 is an outline structure diagram of a two-stage four-valve type pulse tube refrigerator. The two-stage four-valve type pulse tube refrigerator 10 is equipped with a compressor 12, a first-stage regenerator 40, a second-stage regenerator 80, a first-stage pulse tube 50 and a second-stage pulse tube 90, first and second pipes 56 and 86, orifices O3 through O6, and a plurality of on-off valves Va1 through Va6.

The first-stage regenerator 40 has a high-temperature end 42 and a low-temperature end 44. The second-stage regenerator 80 has a high-temperature end 44 (corresponding to a first-stage low-temperature end 44), and a low-temperature end 84. The first-stage pulse tube 50 has a high-temperature end 52 and a low-temperature end 54. The second-stage pulse tube 90 has a high-temperature end 92 and a low-temperature end 94. A heat exchanger is provided to each of the high-temperature ends 52 and 92 and the low-temperature ends 54 and 94 of the first-stage and second stage pulse tubes 50 and 90. The low-temperature end 44 of the first-stage regenerator 40 is connected to the low-temperature end 54 of the first-stage pulse tube 50 through the first pipe 56. The low-temperature end 84 of the second-stage regenerator 80 is connected to the low-temperature end 94 of the second-stage pulse tube 90 through the second pipe 86.

Normally, functions of the on-off valves Va1 through Va6 are achieved by a single component part referred to as a rotary valve. Therefore, a rotary valve is arranged between the compressor 12 and each of the first-stage regenerator 40, the first-stage pulse tube 50 and the second-stage pulse tube 90.

Figure 2:
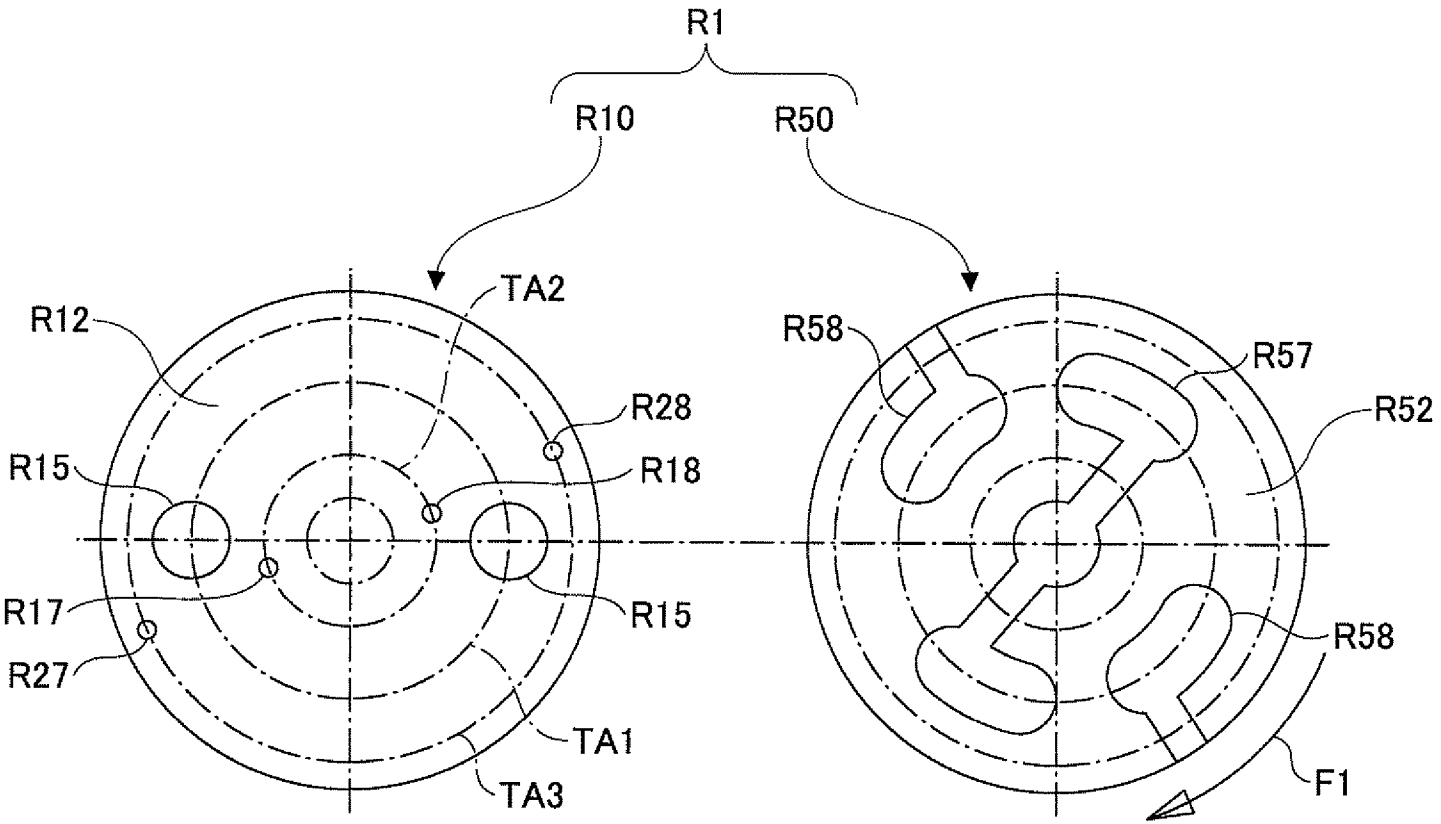
FIG. 2 is a plane view illustrating faces of a stationary seat and a rotary disk that constitute a rotary valve.

FIG. 2 is a plane view illustrating faces of a stationary seat and a rotary disk that together constitute a rotary valve. A circular face R12 of a stationary seat R10 is illustrated on the left side of FIG. 2. A circular face R52 of a rotary disk R50 is illustrated on the right side of FIG. 2. The stationary seat R10 and the rotary disk R50 together form the rotary valve R1. When the rotary valve R1 is in operation, the circular face R12 of the stationary seat R10 and the circular face R52 of the rotary disk R50 are brought into surface-contact with each other.

The rotary disk R50 is provided on the side of the compressor 12, and the stationary seat R10 is provided on the side of the regenerators 42 and 44 and the pulse tubes 50 and 90. That is, a high-pressure coolant gas from the compressor 12 is first supplied to the rotary disk R50, and, thereafter, supplied to the direction of the regenerators 42 and 44 and the pulse tubes 50 and 90 through the stationary seat R10. On the other hand, a low-pressure coolant gas from the regenerators 42 and 44 and the pulse tubes 50 and 90 is returned to the compressor 12 through the rotary disk R50 from the stationary seat R10.

The face R12 of the stationary seat R10 is provided with ports R15, R17 and R18 for supplying a high-pressure coolant gas to the directions toward the first regenerator 40, the first-stage pulse tube 50 and the second-stage pulse tube 90, respectively. The face R12 of the stationary seat R10 is provided with ports R27 and R28 for returning a low-pressure coolant gas to the direction toward the compressor 12 from the first-stage pulse tube 50 and the second-stage pulse tube 90, respectively.

In the face R12 of the stationary seat R10 illustrated in FIG. 2, the two ports R15 for the regenerators 40 and 80 are provided on a curve (track) drawn with the same radius from the center of the face R12. This curve is hereafter referred to as "first track TA1". That is, the two ports R15 are on the first track TA1. Similarly, the ports R17 and R18 are on a second track TA2. Further, the ports R27 and R28 are on the third track TA3. The diameters of the three tracks TA1, TA2 and TA3 are in the following relationship.

The diameter of the second track TA2<the diameter of the first track TA1<the diameter of the third track TA3.

On the other hand, the face R52 of the rotary disk R50 illustrated in FIG. 2 is provided with a total of three holes (grooves) R57 and R58 arranged at positions corresponding to each port formed in the circular face R12 of the stationary seat R10. The hole R57 corresponds to a flow path of a high-pressure coolant gas from the compressor 12. The holes R58 correspond to flow paths of a low-pressure coolant gas to the compressor 12.

When the rotary valve R1 is in operation, the rotary disk R50 rotates in a direction indicated by an arrow F1. When the rotary valve R1 rotates, each port provided on the face R12 of the stationary seat R10 is connected with/disconnected from the three holes R57 and R58 provided on the face R52 of the rotary disk R50 at a predetermined timing, thereby forming predetermined flow paths. According to the operation of the rotary valve R1, opening/closing operations of the valves V1 through V6 of FIG. 1 can be performed.

Here, at least three tracks must be defined in the face R12 of the stationary seat R10 of the rotary valve. The three tracks includes the first track TA1 on which the ports R15 for supplying a high-pressure coolant gas to the regenerators 40 and 80 are arranged, the second track TA2 on which the ports R17 and R18 for supplying a high-pressure coolant gas to the first and second pulse tubes 50 and 90 are arranged, and the third track TA3 on which the port R27 ad R28 for exhausting a low pressure coolant gas from the first and second pulse tubes 50 and 90 are arranged.

Therefore, the face R12 of the stationary seat R10 must have a size in which the three tracks TA1, TA2 and TA3 can be arranged. However, in order to miniaturize the rotary valve R1, it is necessary to miniaturize the stationary seat R10.

A description will be given below, with reference to FIG. 3 through FIG. 5, of embodiments of the present invention.

First Embodiment

Figure 3:
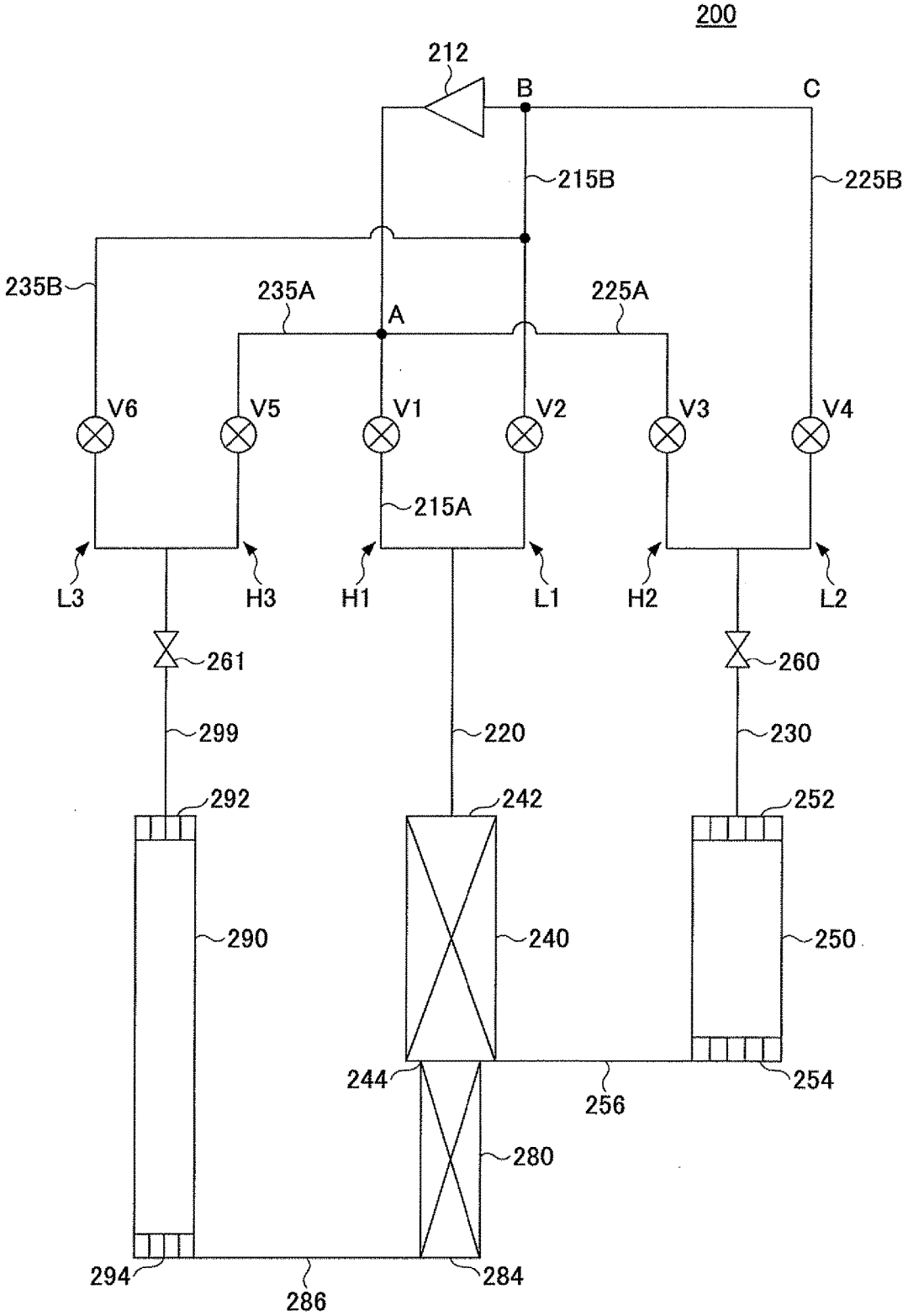
FIG. 3 is a structure diagram of a four-valve type pulse tube refrigerator according to a first embodiment of the present invention.

FIG. 3 is a diagram illustrating an outline structure of a four-valve type pulse tube refrigerator according to a first embodiment of the present invention. The pulse tube refrigerator 200 illustrated FIG. 3 has a two-stage structure.

The pulse tube refrigerator 200 is equipped with a compressor 212, a first-stage regenerator 240, a second-stage regenerator 280, a first-stage pulse tube 250, a second-stage pulse tube 290, first and second pipes 256 and 286, orifices 260 and 261, and a plurality of on-off valves V1 through V6. The first-stage regenerator 240 has a high-temperature end 242 and a low-temperature end 244. The second-stage regenerator 280 has a high-temperature end 244 (corresponding to a first-stage low-temperature end 244) and a low-temperature end 284. The first-stage pulse tube 250 has a high-temperature end 252 and a low-temperature end 254. The second-stage pulse tube 290 has a high-temperature end 292 and a low-temperature end 294. A heat exchanger is provided on each of the high-temperature ends 252 and 292 and the low-temperature ends 254 and 294 of the first-stage and second-stage pulse tubes 250 and 290. The low-temperature end 244 of the first-stage regenerator 240 is connected to the low-temperature end 254 of the first-stage pulse tube 250 through a first pipe 256. The low-temperature end 284 of the second-stage regenerator 280 is connected to the low-temperature end 294 of the second-stage pulse tube 290 through a second pipe 286.

The coolant flow path of the high-pressure side (discharge side) of the compressor 212 is branched into three directions at a point A so that first through third coolant supply paths H1 through H3 are formed. The first coolant supply path H1 includes a high-pressure side pipe of the compressor 212, a first high-pressure side pipe 215A on which the on-off valve V1 is provided, a common pipe 220, and a first-stage regenerator 240. The second coolant supply path H2 includes the high-pressure side pipe of the compressor 212, a second high-pressure side pipe 225A to which the on-off valve V3 is connected, a common pipe 230 in which the orifice 260 is provided, and the first-stage pulse tube 250. The third coolant supply path H3 includes the high-pressure side pipe of the compressor 212, a third high-pressure side pipe 235A to which the on-off valve V5 is connected, a common pipe 299 in which the orifice 261 is provided, and the second-stage pulse tube 290.

On the other hand, a coolant flow path of the low-pressure side (suction side) of the compressor 212 is branched into three directions, that is, first through third coolant recovery paths L1 through L3. The first coolant recovery path L1 includes the first-stage regenerator 240, the common pipe 220, the first low-pressure side pipe 215B on which the on-off valve V2 is provided, a point B, and a low-pressure side pipe of the compressor 212. The second coolant recovery path L2 includes the first-stage pulse tube 250, a common pipe 230 in which the orifice 260 is provided, a second low-pressure side pipe 225B on which the on-off valve V4 is provided, the point B, and the low-pressure side pipe of the compressor 212. The third coolant recovery path L3 includes the second-stage pulse tube 290, a common pipe 299 in which the orifice 261 is provided, a third low-pressure side pipe 235B on which the on-off valve V6 is provided, the point B, and the low-pressure side pipe of the compressor 212.

A description will be given below of an operation of the four-valve type pulse tube refrigerator 200 having the above-mentioned structure.

Figure 4:
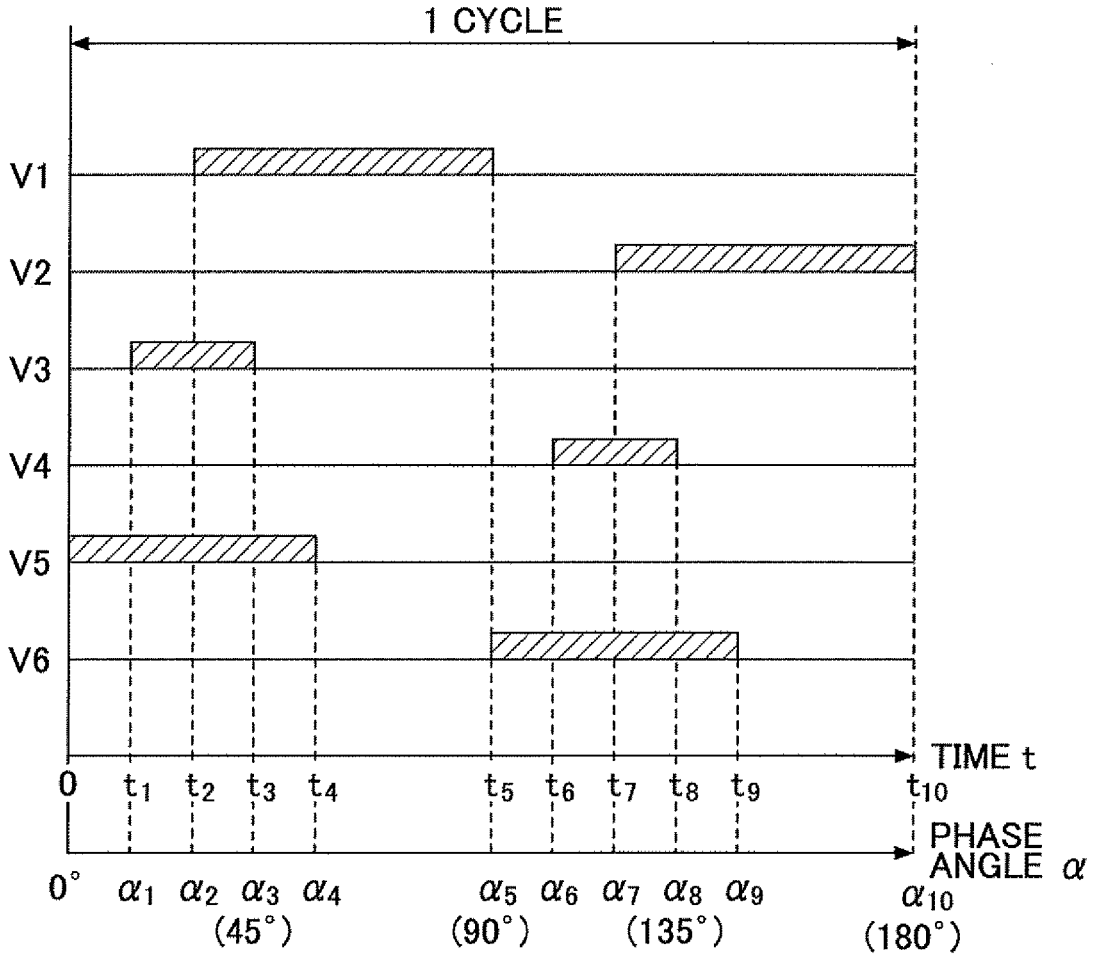
FIG. 4 is a time chart indicating open/close states of six on-off valves during an operation of the pulse tube refrigerator according to the first embodiment.

FIG. 4 is a time chart indicating open/close states of the six on-off valves V1 through V6 during an operation of the pulse tube refrigerator 200. When the pulse tube refrigerator 200 is in operation, the open/close states of the six on-off valves V1 through V6 change periodically as follows.

(First Process: Time 0-t1)

At time t=0, only the on-off valve V5 is opened. Thereby, a high-pressure coolant gas is supplied from the compressor 212 to the second-stage pulse tube 290 through the third coolant supply path H3, that is, through a path routing the third high-pressure side pipe 235A, the common pipe 299, and the high-temperature end 292. Thereafter, at a time t=t1, the on-off valve V3 is opened while the on-off valve V5 is maintained in the open state. Thereby, a high-pressure coolant gas is supplied from the compressor 212 to the first-stage pulse tube 250 through the second coolant supply path H2, that is, through a path routing the second high-pressure side pipe 225A, the common pipe 230 and the high-temperature end 252.

(Second Process: Time t2-t3)

Then, at a time t=t2, the on-off valve V1 is opened while the on-off valves V5 and V3 are maintained in the open state. Thereby, the high-pressure coolant gas is introduced from the compressor 212 into the first-stage and second-stage regenerators 240 and 280 through the first coolant supply path H1, that is, through a path routing the first high-pressure side pipe 215A, the common pipe 220 and the high-temperature end 242. A part of the coolant gas flows into the first-stage pulse tube 250 from the low-temperature end 254 through the first pipe 256. A remaining part of the coolant gas flows into the second-stage pulse tube 290 from the low-temperature end 294 through the second pipe 286.

(Third Process: Time t3-t5)

Then, at a time t=t3, the on-off valve V3 is closed while the on-off valve V1 and V5 are maintained in the open state. Thereafter, at a time t=t4, also the on-off valve V5 is closed. Thus, the coolant gas from the compressor 212 flows into the first-stage regenerator 240 only through the first coolant supply path H1. Thereafter, the coolant gas flows into both the pulse tubes 250 and 290 from the low-temperature ends 254 and 294, respectively.

(Fourth Process: Time t=t5)

At a time t=t5, all of the on-off valves V1 through V6 are closed. Because the pressures inside the first-stage and second-stage pulse tubes 250 and 290 increase, the coolant gas in the first-stage and second-stage pulse tubes 250 and 290 flows toward a reservoir (not illustrated in the figure) provided on the side of the high-temperature ends 252 and 292 of the first-stage and second-stage pulse tubes 250 and 290.

(Fifth Process: Time t5-t7)

Thereafter, at a time t=t5, the on-off valve V6 is opened, and the coolant gas in the second-stage pulse tube 290 returns to the compressor 212 by flowing through the third coolant recovery path L3. Then, at a time t=t6, the on-off valve V4 is opened, and the coolant gas in the first-stage pulse tube 250 returns to the compressor 212 by flowing through the second coolant recovery path L2. Thereby, the pressures in both the pulse tubes 250 and 290 decrease.

(Sixth Process: Time t7-t8)

Then, at a time t=t7, the on-off valve V2 is opened while the on-off valves V6 and V4 are maintained in the open state. Thereby, a large part of the coolant gas in both the pulse tubes 250 and 290 and the second-stage regenerator 280 flows through the first-stage regenerator 240, and returns to the compressor 212 by flowing through the first coolant recovery path L1.

(Seventh Process: Time t8-t10)

Then, at a time t=t8, the on-off valve V4 is closed while the on-off valve V2 and V6 are in the open state. Thereafter, at a time t=t9, also the on-off valve V6 is closed. Thereafter, at a time t=t10, the on-off valve V2 is closed, and one cycle is completed.

By repeating the above-mentioned cycle, the low-temperature end 254 of the first-stage pulse tube 250 and the low-temperature end 294 of the second-stage pulse tube 290 are caused to be at a low-temperature, which can cool an object to be cooled.

In the timing chart of FIG. 4, the time lengths of the open states of the on-off valves are set in an order of the on-off valve V1>the on-off-valve V5>the on-off valve V3 and the on-off valve V2>the on-off valve V6>the on-off valve V4. However, this is an example and a different combination may be used as the time length of the open state of each on-off valve.

(Rotary Valve)

A description will now be given, with reference to FIG. 5, of a structure of the rotary valve in order to perform the operations of the on-off valves V1 through V6 at a timing indicated in FIG. 4.

Figure 5:
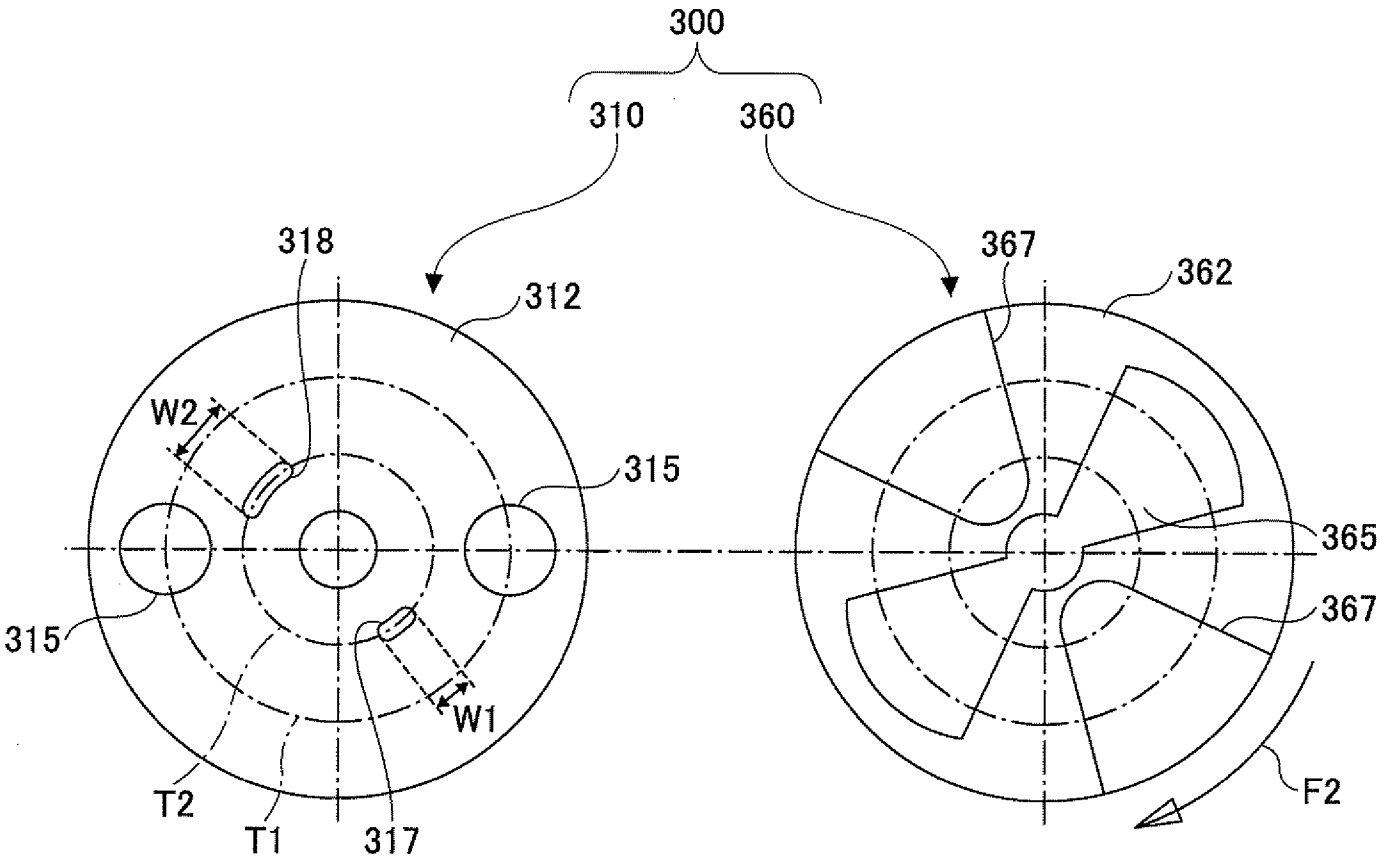
FIG. 5 is a plan view illustrating faces of a stationary seat and a rotary disk that constitute a rotary valve according to the first embodiment.

FIG. 5 is a plan view of the faces of the stationary seat and the rotary disk that constitute the rotary valve according to the first embodiment. The circular face 312 of the stationary seat 310 is illustrated on the left side of FIG. 5. The circular face 362 of the rotary disk 360, which is brought into surface-contact with the face 312 of the stationary seat 310, is illustrated on the right side of FIG. 5. The stationary seat 310 and the rotary disk 360 together form the rotary valve 300.

In FIG. 5, the face 312 of the stationary seat 310 is provided with two ports 315, one port 317 and one port 318. In the example illustrated in FIG. 5, each of the ports 315 is substantially circular. Each of the ports 317 and 318 has a substantially elongated circular shape, which is elongated in a circumferential direction of the face 312. A width W2 (an overall length in the circumferential direction of the face 312) of the port 318 is larger than a width W1 (an overall length in the circumferential direction of the face 312) of the port 317.

The two ports 315 play a role of supplying a high-pressure coolant gas, which is supplied from the first coolant supply path H1 through the rotary disk 360, to the regenerators 240 and 280, and exhausting a low-pressure coolant gas in the regenerators 240 and 280 toward the first low-pressure side pipe L1 through the rotary disk 360. Hereinafter, the two ports 315 may be referred to as "regenerator ports 315". The port 317 plays a role of supplying a high-pressure coolant gas, which is supplied from the second coolant supply path H2 through the rotary disk 360, to the first-stage pulse tube 250, and exhausting a low-pressure coolant gas in the first-stage pulse tube 250 toward the second low-pressure side pipe L2 through the rotary disk 360. Hereinafter, the port 317 may be referred to as "first-stage pulse tube port 317". The port 318 plays a role of supplying a high-pressure coolant gas, which is supplied from the third coolant supply path H3 through the rotary disk 360, to the second-stage pulse tube 290, and exhausting a low-pressure coolant gas in the second-stage pulse tube 290 toward the third low pressure side pipe L2 through the rotary disk 360. Hereinafter, the port 318 may be referred to as "second-stage pulse tube port 318".

As illustrated in FIG. 5, the two regenerator ports 315 are located at positions of the same distance (radius) from the center of the circular face 312 of the stationary seat 310. Hereafter, the circumferential line of the same radius passing through the regenerator ports 315 is referred to as a track T1. Similarly, the first-stage pulse tube port 317 and the second-stage pulse tube port 318 are located at positions of the same distance (radius) from the center of the circular face 312 of the stationary seat 310. Hereafter, the circumferential line of the same radius passing through the ports 317 and 318 is referred to as a track T2.

As apparent from FIG. 5, the two ports 315 are located at positions which are substantially rotationally symmetrical with respect the center of the face 312. Similarly, the ports 317 and 318 are located at positions which are substantially rotationally symmetrical with respect the center of the face 312.

On the other hand, as illustrated in FIG. 5, the circular face 362 of the rotary disk 360 has one elongated hole 365, which extends in a radial direction by passing through the center of the circular face 362, and two small holes 367, which extend toward the center from the outer peripheral end of the face 362. The small holes 367 are provided in the circular face 362 so that they are rotationally symmetric with respect to the center of the circular face 362. Hereinafter the elongated hole 365 is referred to as "high-pressure flow path opening 365" because it is a flow passage of a high-pressure coolant gas. The two small holes 367 may be referred to as "low-pressure flow path openings 367" because they are flow passages of a low-pressure coolant gas.

In the example illustrated in FIG. 5, a passage for a high-pressure coolant gas is open at the center of the face 362 of the rotary disk 360. The passage opening at the center of the face 362 is communicated with the high-pressure flow path opening 365. Additionally, a space for a low-pressure coolant gas is formed outside the face 362 of the rotary disk 360. The low-pressure flow path openings 367 are communicated with the space outside the face 362.

When the rotary valve 300 is in operation, the face 362 of the rotary disk 360 rotates relative to the face 312 of the stationary seat 310. During an operation of the rotary valve 300, when the high-pressure flow path opening 365 and the low-pressure flow path openings 367, which are provided on the face 362 of the rotary disk 360, reach and pass the ports 315, 317 and 318 provided on the face 312 of the stationary seat 310, the coolant gas is caused to flow through the rotary valve 300 at timings indicated in FIG. 4. In other words, the sizes and positions of the high-pressure flow path opening 365 and the low-pressure flow path openings 367, which are provided on the face 362 of the rotary disk 360, and the ports 315, 317 and 318 provided on the face 312 of the stationary seat 310 are determined so that they are in a relative positional relationship with which a flow of the coolant gas is achieved at the timings indicated in FIG. 4 when the rotary disk 360 rotates in a direction indicated by an arrow F2 of FIG. 5.

A description will be given below, with reference to FIG. 4, of a relationship between a rotational angle (phase angle) $\alpha$ of the rotary disk 360 of the rotary valve 300 and opening and closing of the valves V1 through V6 illustrated in FIG. 3. In FIG. 4, a horizontal axis representing the phase angle $\alpha$ is indicated as a second horizontal axis.

(Phase Angle $\alpha$=0°-90°)

First, when the high-pressure flow path opening 365 of the rotary disk 360 is brought into communication with the second-stage pulse tube port 318 of the stationary seat 310, a high-pressure coolant gas is introduced into the second-stage pulse tube 290. This corresponds to a state (time t=0) where the valve V5 is opened in FIG. 4. When the rotary disk 360 rotates further ($\alpha=\alpha 1$), the high-pressure flow path opening 365 of the rotary disk 360 is also brought into communication with the first-stage pulse tube port 317 of the stationary seat 310, thereby introducing the high-pressure coolant gas into the first-stage pulse tube 250. This corresponds to a state (time t=t1) where the valve V3 is opened in FIG. 4. When the rotary disk 360 rotates further ($\alpha=\alpha 2$), the high-pressure flow path opening 365 of the rotary disk 360 is also brought into communication with the regenerator ports 315 of the stationary seat 310, thereby introducing the high-pressure coolant gas into the regenerator 240. This corresponds to a state (time t=t2) where the on-off valve V1 is opened in FIG. 4.

Thereafter, when the face 362 of the rotary disk 360 rotates further, the high-pressure flow path opening 365 is brought into noncommunication with the first-stage pulse tube port 317 at the phase angle $\alpha=\alpha 3$, and the high-pressure flow path opening 365 is brought into noncommunication with the second-stage pulse tube port 318 at the phase angle $\alpha=\alpha 4$. Accordingly, the supply of the high-pressure coolant gas to the first-stage pulse tube 250 and the second-stage pulse tube 290 is stopped (corresponding to closing of the on-off valves V3 and V5). Further, when the phase angle $\alpha$ reaches 90° ($\alpha=\alpha 5$), the supply of the high-pressure coolant gas to the regenerator 240 is also stopped (corresponding to closing of the on-off valve V1).

(Phase Angle $\alpha$=90°-180°)

On the other hand, at the phase angle $\alpha=\alpha 5$ (90°), the low-pressure flow path opening 367 is brought into communication with the second-stage pulse tube port 318 of the stationary seat 310, and, thereby, an exhaust of a low-pressure coolant gas from the second-stage pulse tube 290 is started (corresponding to opening of the on-off valve V6). Additionally, at the phase angle of $\alpha=\alpha 6$ and $\alpha=\alpha 7$, the low-pressure flow path 367 of the rotary disk 360 is sequentially brought into communication with the first-stage pulse tube port 317 and the regenerator ports 315 (corresponding to opening of the on-off valves V4 and V2, respectively). Thereby, an exhaust of the low-pressure coolant gas from the first-stage pulse tube 250 and the regenerators 240 and 280 is started.

Then, at the phase angle $\alpha=\alpha 8$, the low-pressure flow path 367 of the rotary disk 360 is brought into noncommunication with the first-stage pulse tube port 317, and, thereby, the exhaust of the low-pressure coolant gas from the first-stage pulse tube 250 is stopped (corresponding to closing of the on-off valve V4). At the phase angle $\alpha=\alpha 9$, the low-pressure flow path 367 of the rotary disk 360 is also brought into noncommunication with the second-stage pulse tube port 318, and, thereby, the exhaust of the low-pressure coolant gas from the second-stage pulse tube 290 is stopped (corresponding to closing of the on-off valve V6).

Finally, at the phase angle $\alpha=\alpha 10$, the low-pressure flow path 367 of the rotary disk 360 is also brought into noncommunication with the regenerator ports 315 of the stationary seat 310, and, thereby, the exhaust of the low-pressure coolant gas from the regenerators 240 and 280 is stopped (corresponding to closing of the on-off valve V2).

A one cycle of the above-mentioned cooling cycle is completed by 180° rotation of the rotary disk 360. Accordingly, in the case of the rotary valve 300 as illustrated in FIG. 5, one complete rotation of the rotary disk 360 corresponds to two cycles of the cooling cycle.

As mentioned above, in the rotary valve R1 illustrated in FIG. 2, at least three tracks TA1, TA2 and TA3 are needed in the face R12 of the stationary seat R10. Accordingly, there is a limitation in reducing the size of the rotary valve R1.

On the other hand, in the rotary valve 300 according to the present embodiment, the number of tracks in the face 312 of the stationary seat 310 is reduced to two. Therefore, the diameter of the face 312 of the stationary seat 310 can be reduced. Thereby, the rotary valve 300 can be miniaturized, and a torque needed for rotating the rotary disk 360 can be reduced. Moreover, because the face 312 of the stationary seat 310 and the face 362 of the rotary disk 360 are made smaller, there is an effect provided that an amount of abrasion particles generated due to wear of both the faces 312 and 362 can be reduced.

Further, in the rotary valve 300 according to the present embodiment, the two ports 315 are arranged at substantially rotation symmetric positions with respect to the center of the face 312 of the stationary seat 310. Moreover, ports 317 and 318 are arranged at substantially rotation symmetric positions with respect to the center of the face 312 of the stationary seat 310.

Therefore, in the rotary valve 300 according to the present embodiment, both the faces 312 and 362 are in surface-contact with each other stably during the rotation of the rotary disk 360, thereby suppressing generation of a gap between the faces 312 and 362 or, on the contrary, suppressing a hard contact of the faces 312 and 362 with each other. Thus, a stable operation of the rotary valve 300 can be achieved, and generation of abrasion particles due to wear of the faces 312 and 362 can be suppressed. Further, a multi-valve type pulse tube refrigerator equipped with such a rotary valve can maintain a stable cooling characteristic for a long time.

It should be noted that the shapes of the ports and the holes and the relative positional relationship illustrated in FIG. 5 are mere examples, and the present invention is applicable to a rotary valve with different shapes of the ports and the holes and different relative positional relationship.

As mentioned above, the present embodiment provides the following two features.

(i) The second track TA2 for the ports R17 and R18 to supply a high-pressure coolant gas to the pulse tubes 50 and 90 and the third track TA3 for the ports R27 and R28 to exhaust a low-pressure coolant gas from the pulse tubes 50 and 90 are integrated into one track in order to reduce the number of tracks to two (T1 and T2).

(ii) In each of the track T1 and T2, a plurality of ports are arranged at substantially rotation symmetric positions.

In the scope of the above-mentioned features, shapes of the ports and holes and relative positional relationship can be changed if necessary.

Moreover, in the present embodiment, a so-called "one-rotation two-cycle system" is explained in which one rotation of the rotary disk 360 corresponds to two cycles of the cooling cycle. However, the present invention is not limited to the "one-rotation two-cycle system" and is applicable to other systems such as "one-rotation three-cycle system".

In the present embodiment, the center of each of the regenerator ports 315 is not necessarily arranged on the line of the track T1, which is at the same distance from the center of the face 312. Similarly, the center of each of the first pulse tube port 317 and the second pulse port 318 is not necessarily arranged on the line of the track T2, which is at the same distance from the center of the face 312. That is, the track does not mean a circle (line) but corresponds to an area having a certain width. Thus, in the present application, the track may be referred to as "track area".

Figure 6:
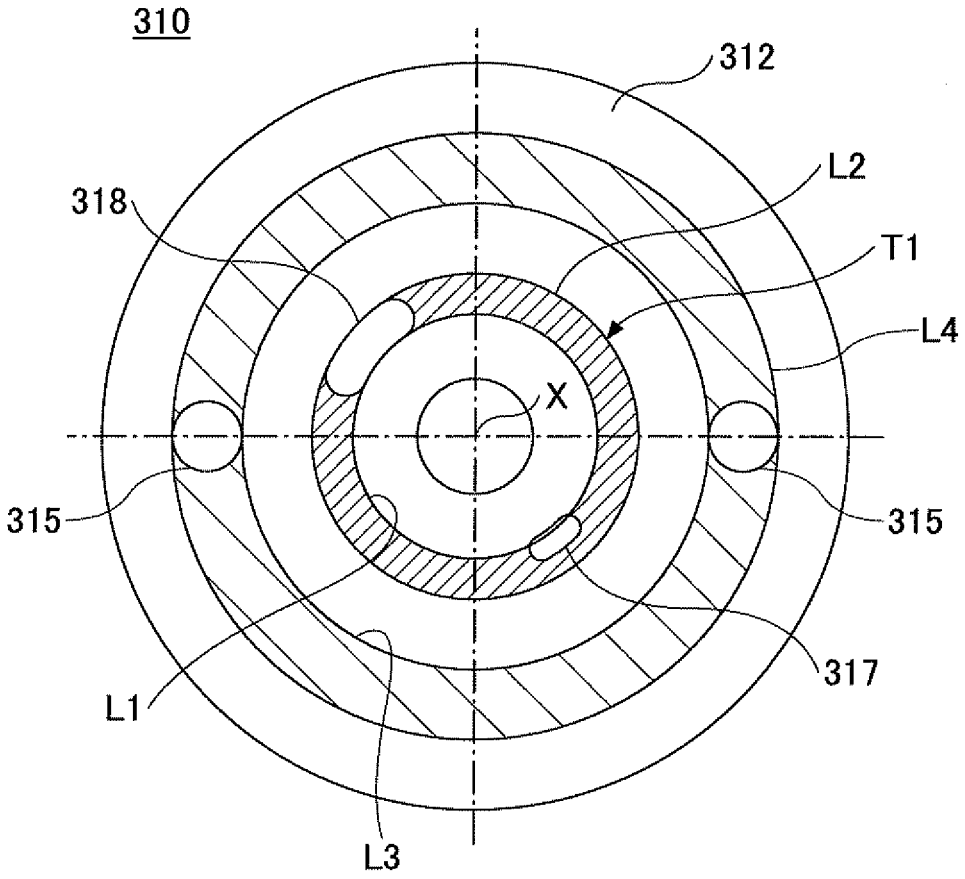
FIG. 6 is an illustration of the face of the stationary seat for explaining a concept of a "track area"

A description is given below of such a "track" or a "track area". FIG. 6 is an illustration of the face 312 of the stationary seat 310 for explaining the concept of the "track area". The "track area" (the first track T2) is defined as follows.

First, one of the first-stage pulse tube ports 317 and the second-stage pulse tube port 318, which has a larger size in a radial direction of the face 312, is selected (in this case, the second-stage pulse tube port 318 is selected). Then, concentric circles L1 and L2 having the center as the center X of the face 312 are drawn so that the selected port is just contained in an area between the circles L1 and L2 (L1<L2).

The thus-obtained area between the concentric circles L1 and L2 (a hatched portion in FIG. 6) is the "track area". Then, if the center of the port having a smaller size in a radial direction of the face 312 (in this case, the first-stage pulse tube port 317) is located within the "track area", it can be said that both the ports 317 and 318 are on the same track (the second track T2).

With respect to the two regenerator ports 315, it can be determined whether the two regenerator ports 315 are on the same track (the first track T1) by defining the "track area" (the first track T1) by drawing concentric circles L3 and L4 in the same manner as the ports 317 and 318.

Second Embodiment

A description will now be given, with reference to FIG. 7 through FIG. 9, of a second embodiment of the present invention.

Figure 7:
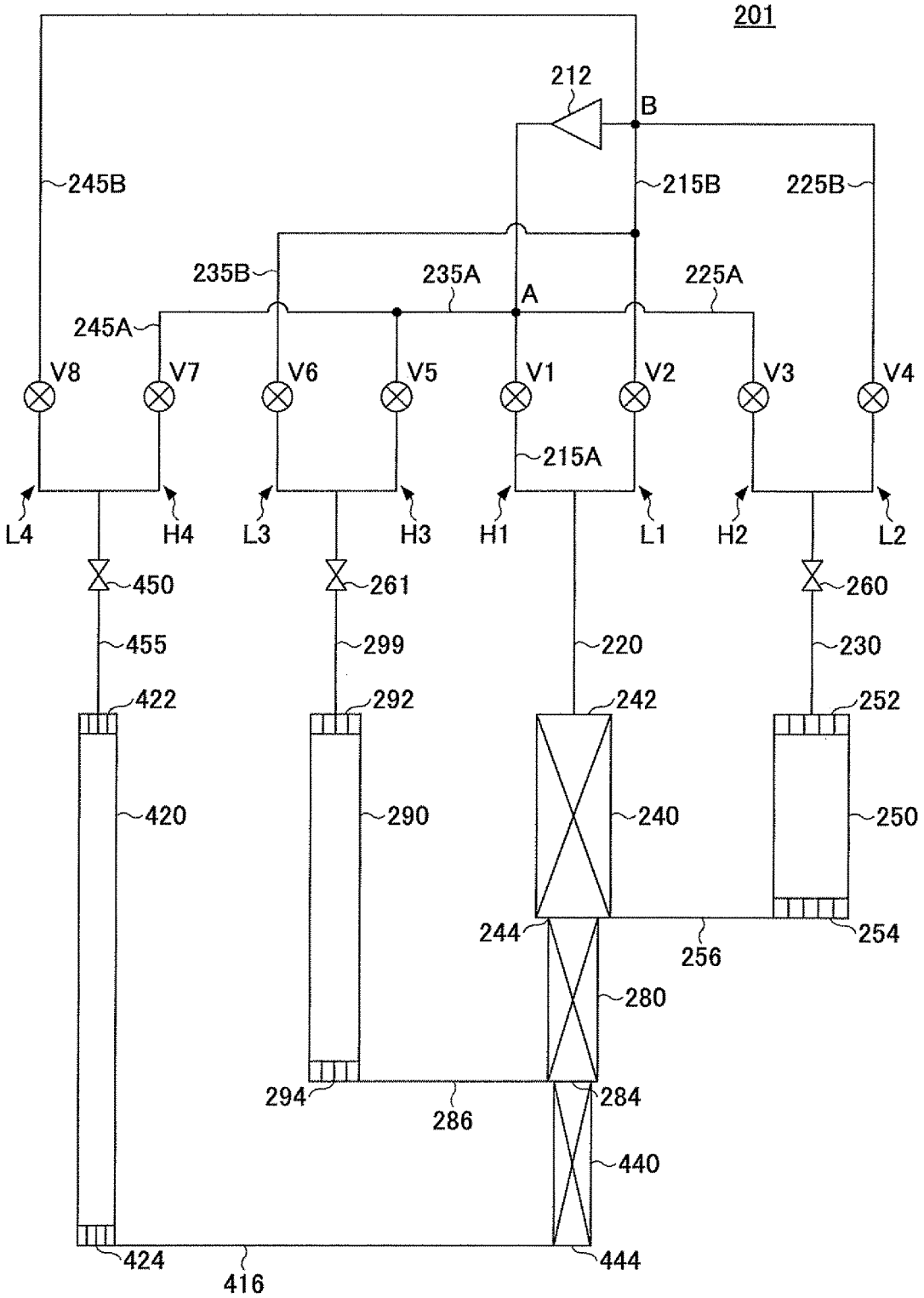
FIG. 7 is a structure diagram of a four-valve type pulse tube refrigerator according to a second embodiment of the present invention.

FIG. 7 is a diagram illustrating a structure of a four-valve type pulse tube refrigerator according to the second embodiment of the present invention. The pulse tube refrigerator 201 has a three-stage structure. In FIG. 7, parts that are the same as the parts illustrated in FIG. 3 are given the same reference numerals.

The three-stage type pulse tube refrigerator 201 has the same structure as the two-stage type pulse tube refrigerator 200 except that the three-stage type pulse tube refrigerator 201 further includes a third-stage regenerator 440 and a third-stage pulse tube 420.

The third-stage regenerator 440 has a high-temperature end 284 (corresponding to the low-temperature end of the second-stage regenerator 280) and a low-temperature end 444. The third-stage pulse tube 420 has a high-temperature end 422 and a low-temperature end 424, and a heat exchanger is provided to each of the high-temperature end 422 and the low-temperature end 424. The low-temperature end 444 of the third-stage regenerator 440 is connected to the low-temperature end 424 of the third-stage pulse tube 420 through a third pipe 416.

A coolant flow path of the high-pressure side (discharge side) of the compressor 212 includes a fourth coolant supply path H4 in addition to the first through third coolant supply paths H1 through H3 illustrated in FIG. 3. Additionally, the coolant flow path on the low-pressure side (suction side) of the compressor 212 includes a fourth coolant recovery path L4 in addition to the first through third coolant recovery paths L1 through L3 illustrated in FIG. 3.

The fourth coolant supply path H4 includes a high-pressure side pipe of the compressor 212, a fourth high-pressure side pipe 245A to which an on-off valve V7 is connected, a common pipe 455 in which an orifice 450 is provided, and the third-stage pulse tube 420. The fourth coolant recovery path L4 includes the third-stage pulse tube 420, the common pipe 455 in which the orifice 450 is provided, a fourth low-pressure side pipe 245B in which an on-off valve V8 is provided, a point B, and a path passing the compressor 212.

A description is given below of an operation of the four-valve type pulse tube refrigerator 201.

Figure 8:
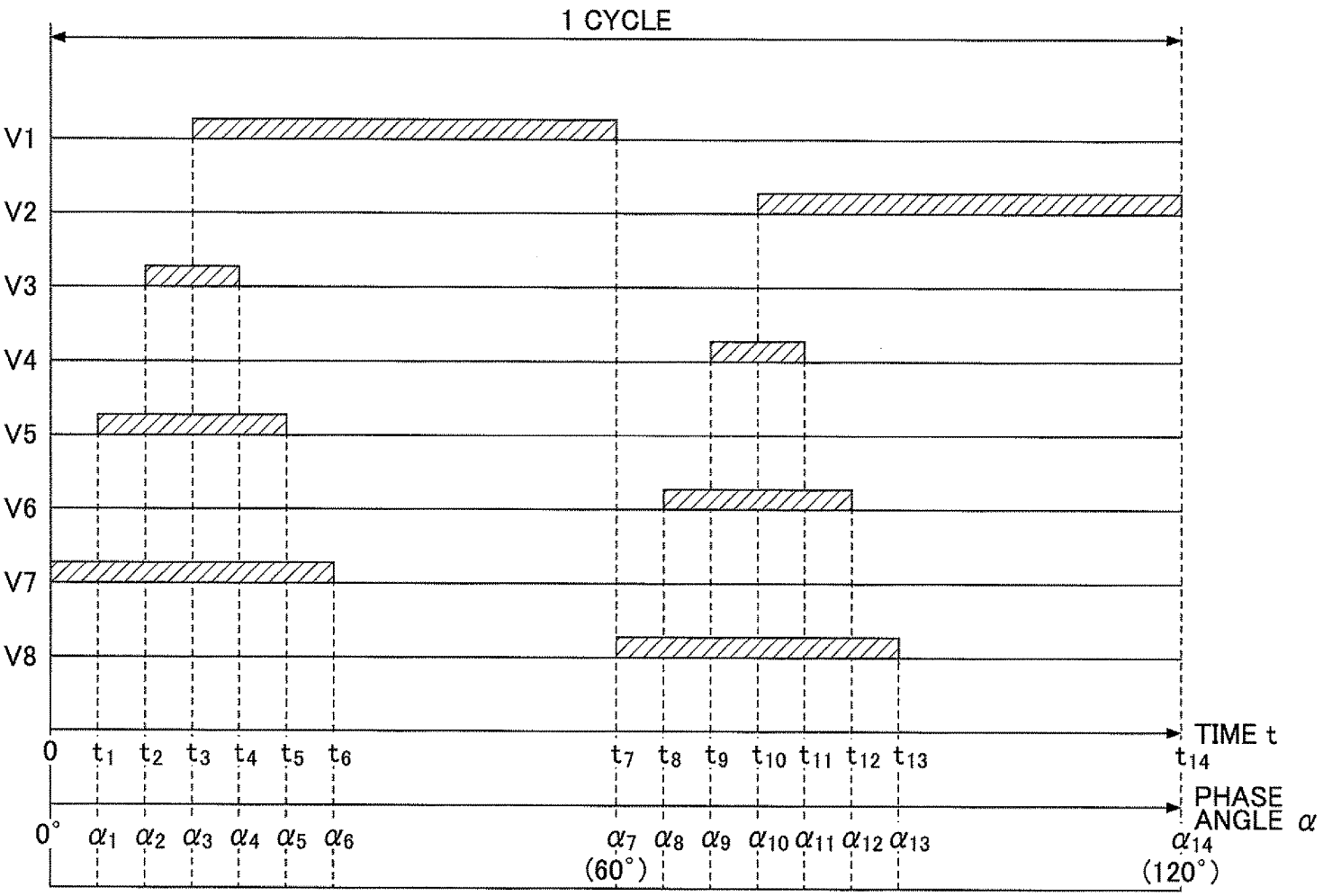
FIG. 8 is a time chart indicating open/close states of eight on-off valves during an operation of the pulse tube refrigerator according to the second embodiment.

FIG. 8 is a time chart indicating open/close states of the eight on-off valves V1 through V8 during an operation of the pulse tube refrigerator 201. When the pulse tube refrigerator 201 is in operation, the open/close states of the eight on-off valves V1 through V8 are changed periodically as explained below.

(First Process: Time 0-t3)

First, at a time t=0, only the on-off valve V7 is opened. Thereby, a high-pressure coolant gas is supplied from the compressor 212 to the third-stage pulse tube 420 through the fourth coolant supply path H4, that is, through a path routing the fourth high-pressure side pipe 245A, the common pipe 455 and the high-temperature end 422. Thereafter, at a time t=t1, the on-off valve V5 is opened while the on-off valve V7 is maintained in the open state.

Then, at a time t=t2, the on-off valve V3 is opened while the on-off valves V7 and V5 are maintained in the open state. Thereby, the high-pressure coolant gas is supplied from the compressor 212 to the first-stage pulse tube 250 through the second coolant supply path H2, that is, through a path routing the first high-pressure side pipe 225A, the common pipe 230 and the high-temperature end 252.

Then, at a time t=t3, the on-off valve V1 is opened while the on-off valves V7, V5 and V3 are maintained in the open state. Thereby, the high-pressure coolant gas is introduced into the first-stage through third-stage regenerators 240, 280 and 440. A part of the coolant gas flows into the first-stage pulse tube 250 from the side of the low-temperature end 254 through the first pipe 256. A different part of the coolant gas flows through the second-stage regenerator 280 and flows into the second-stage pulse tube 290 from the side of the low-temperature end 294 through the second pipe 286. A further different part of the coolant gas flows through the third-stage regenerator 440 and flows into the third-stage pulse tube 420 from the side of the low-temperature end 424 through the third pipe 416.

(Second Process: Time t4-t7)

Then, at a time t=t4, the on-off valve V3 is closed while the on-off valves V1, V5 and V7 are maintained in the open state. Thereafter the on-off valves V5 and V7 are sequentially closed (at a time t=t5 and t=t6). Thereby, the coolant gas from the compressor 212 is caused to flow into the first-stage regenerator 240 through only the first coolant supply path H1. Thereafter, the coolant gas flows into the three pulse tubes 250, 290 and 420 from the low-temperature ends 254, 294 and 424.

At a time t=t7, all of the on-off valves V1 through V8 are closed. Because the pressures inside the first through third pulse tubes 250, 290 and 420 increase, the coolant gas in the first through third pulse tubes 250, 290 and 420 flows toward a reservoir (not illustrated in the figure) provided on the side of the high-temperature ends 252, 292 and 422 of the first through third pulse tubes 250, 290 and 420.

(Third Process: Time t7-t10)

Thereafter, at a time t=t7, the on-off valve V8 is opened, and the coolant gas in the third-stage pulse tube 420 returns to the compressor 212 by flowing through the fourth coolant recovery path L4. Then, at a time t=t8, the on-off valve V6 is opened, and the coolant gas in the second-stage pulse tube 290 returns to the compressor 212 by flowing through the third coolant recovery path L3. Thereby, the pressures in both the pulse tubes 420 and 290 decrease. Thereafter, at a time t=t9, the on-off valve V4 is opened, and the coolant gas in the first-stage pulse tube 250 returns to the compressor by flowing through the second coolant recovery path L2. Thereby, the pressure inside the first-stage pulse tube 250 decreases.

Further, at a time t=t10, the on-off valve V2 is opened while the on-off valves V8, V6 and V4 are maintained in the open state. Thereby, a large part of the coolant gas in the pulse tubes 420, 290 and 250 and the regenerators 240, 280 and 440 returns to the compressor 212 by flowing through the first-stage regenerator 240 and through the first coolant recovery path L1.

(Fourth Process: Time t11-t14)

Then, at a time t=t11, the on-off valve V4 is closed while the on-off valves V2, V6 and V8 are in the open state. Thereafter, the on-off valves V6 and V8 are closed sequentially (at a time t=t12 and t=t13). Finally, at a time t=t14, the on-off valve V2 is closed, and one cycle is completed.

By repeating the above-mentioned cycle, the low-temperature end 254 of the first-stage pulse tube 250, the low-temperature end 294 of the second-stage pulse tube 290 and the low-temperature end 424 of the third-stage pulse tube 420 are caused to be at a low-temperature, which can cool an object to be cooled.

In the timing chart of FIG. 8, the time lengths of the open states of the on-off valves are set in an order of the on-off valve V1>the on-off-valve V7>the on-off valve V5>the on-off valve V3 and the on-off valve V2>the on-off valve V8>the on-off valve V6>the on-off valve V4. However, this is an example and a different combination may be used as the time length of the open state of each on-off valve.

Rotary Valve According to the Second Embodiment

A description will now be given, with reference to FIG. 9, of a structure of the rotary valve according to the second embodiment in order to perform the operations of the on-off valves V1 through V8 at timings indicated in FIG. 8.

Figure 9:
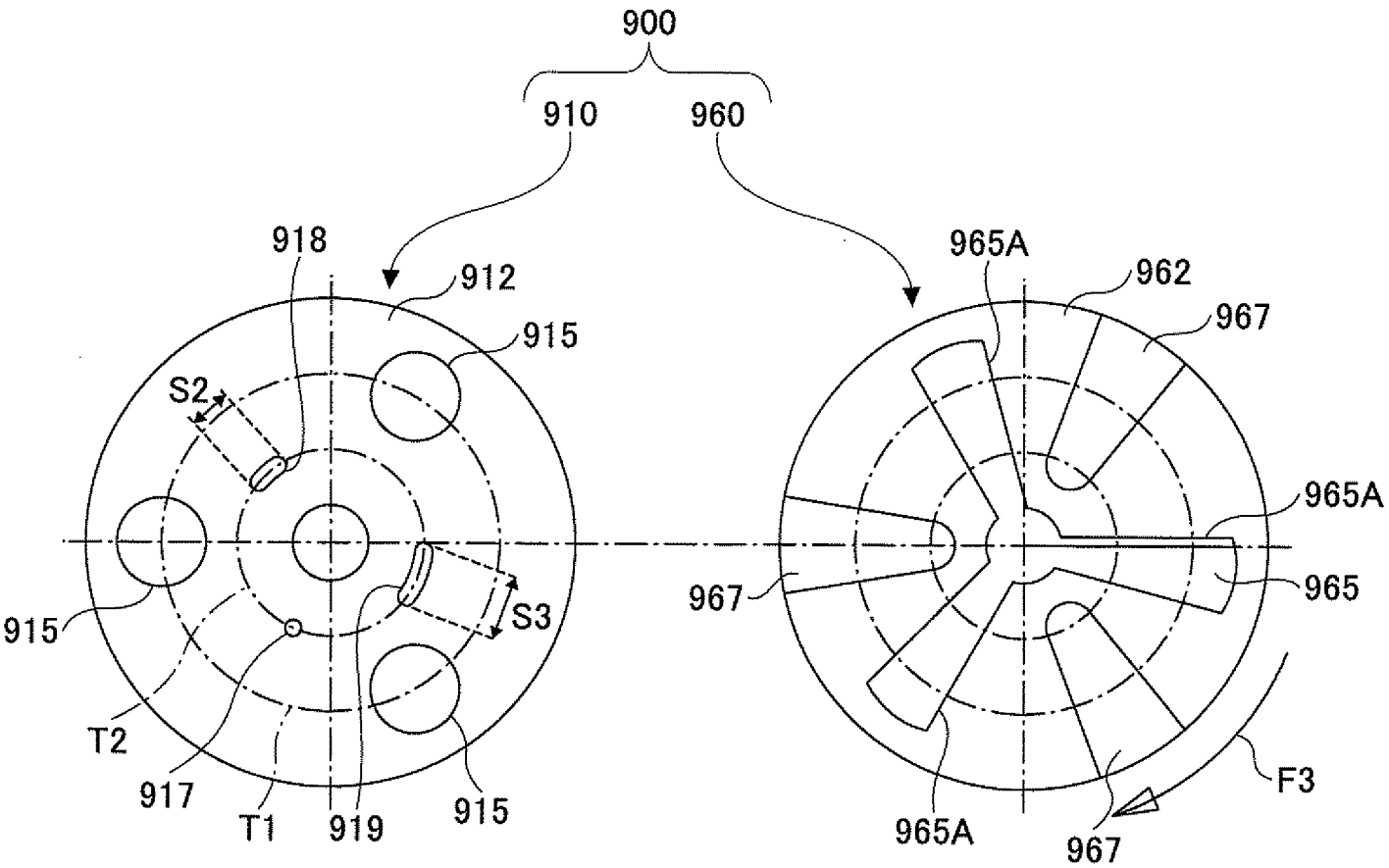
FIG. 9 is a plan view illustrating faces of a stationary seat and a rotary disk that constitute a rotary valve according to the second embodiment.

FIG. 9 is a plan view of faces 912 and 962 of a stationary seat 910 and a rotary disk 960 that constitute the rotary valve 900 according to the second embodiment. The circular face 912 of the stationary seat 910 is illustrated on the left side of FIG. 9. The circular face 962 of the rotary disk 960, which is brought into surface-contact with the face 912 of the stationary seat 910, is illustrated on the right side of FIG. 9.

As illustrated in FIG. 9, ports 915, 917, 918 and 919 are provided in the face 912 of the stationary seat 910. In the example of FIG. 9, each of the ports 915 and 917 is a substantially circular shape, and each of the ports 918 and 919 has a substantially elongated circular shape which is elongated in a circumferential direction of the face 912. In the example of FIG. 9, a width S3 (an overall length in a circumferential direction of the face 912) is larger than a width S2 (an overall length in a circumferential direction of the face 912) of the port 918. A width S2 of the port 918 is larger than a diameter S1 of the port 917. A diameter of each of the ports 915 is larger than the width S3 of the port 919.

The three ports 915 play a role of supplying a high-pressure coolant gas from the first coolant supply path H1 to the regenerators 240, 280 and 440, and exhausting a low-pressure coolant gas from the regenerators 240, 280 and 440 to the first low-pressure side pipe L1. Hereinafter, the three ports 915 are referred to as "cold-accumulating ports 915". The port 917 plays a role of supplying a high-pressure gas from the second coolant supply path H2 to the first-stage pulse tube 250, and exhausting a low-pressure gas inside the first-stage pulse tube 250 to the second low-pressure side pipe L2. Hereinafter, the port 917 is referred to as "first-stage pulse tube port 917". The port 918 plays a role of supplying a high-pressure gas from the third coolant supply path H3 to the second-stage pulse tube 290, and exhausting a low-pressure gas inside the second-stage pulse tube 290 to the third low-pressure side pipe L3. Hereinafter, the port 918 is referred to as "second-stage pulse tube port 918". The port 919 plays a role of supplying a high-pressure gas from the fourth coolant supply path H4 to the third-stage pulse tube 420, and exhausting a low-pressure gas inside the third-stage pulse tube 420 to the fourth low-pressure side pipe L4. Hereinafter, the port 919 is referred to as "third-stage pulse tube port 919".

As illustrated in FIG. 9, each of the three cold-accumulating ports 915 is arranged on the track T1. In other words, the center of each of the three cold-accumulating ports 915 is contained in the track area T1. Similarly, the center of each of the first-stage pulse tube port 917, the second-stage pulse tube port 918 and the third-stage pulse tube port 919 is arranged on the track T2. In other words, the three ports 917, 918 and 919 are contained in the track area T2.

On the other hand, the circular face 962 of the rotary disk 960 has one high-pressure flow path opening 965 and three low-pressure flow path openings 967. The high-pressure flow path opening 965 includes three wing parts 965A extending in three directions. The wing parts 965A extend in radial directions so that an angle formed between the adjacent wing parts 965A is 120 degrees. The three low-pressure flow path openings 967 are arranged between the wing parts 965A of the high-pressure flow path opening 965 so that they are substantially rotation symmetric with each other with respect to the circular face 962.

During an operation of the rotary valve 900, the face 962 of the rotary disk 960 rotates with respect to the face of the stationary seat 910. During the rotation, the high-pressure flow path opening 965 and the low-pressure flow path opening 967 provided in the face 962 of the rotary disk 960 pass the ports 915, 917, 918 and 919 provided in the face 912 of the stationary seat 910, which results in a flow of the coolant gas at timings indicated in FIG. 8. In other words, the high-pressure flow path opening 965 and the low-pressure flow path opening 967 of the face 962 of the rotary disk 960 and the ports 915, 917, 918 and 919 of the face 912 of the stationary seat 910 are configured and arranged so that a coolant gas flow is achieved at timings indicated in FIG. 8 when the rotary disk 960 is rotated.

When the face 962 of the rotary disk 960 of the rotary valve 900 rotates in a direction indicated by an arrow F3 of FIG. 9, the relationship indicated in FIG. 8 (that is, the relationship between the rotation angle (phase angle) α and the on-off valves V1 through V8) is acquired according to the relative positional relationship of each ports of the stationary seat 910 and each port of the rotary disk 960. Thus, a description of the rotation angle and the relationship of the on-off valves are omitted. However, the structure of the rotary valve 900 illustrated in FIG. 9 corresponds to a "one-rotation three-cycle system".

Also in the second embodiment, an effect the same as the first embodiment is obtained. That is, also according to the second embodiment, a reduction in a diameter of the faces and miniaturization of the rotary valve can be achieved.

Third Embodiment

A description will now be given of a four-valve type pulse tube refrigerator according to a third embodiment of the present invention.

Figure 10:
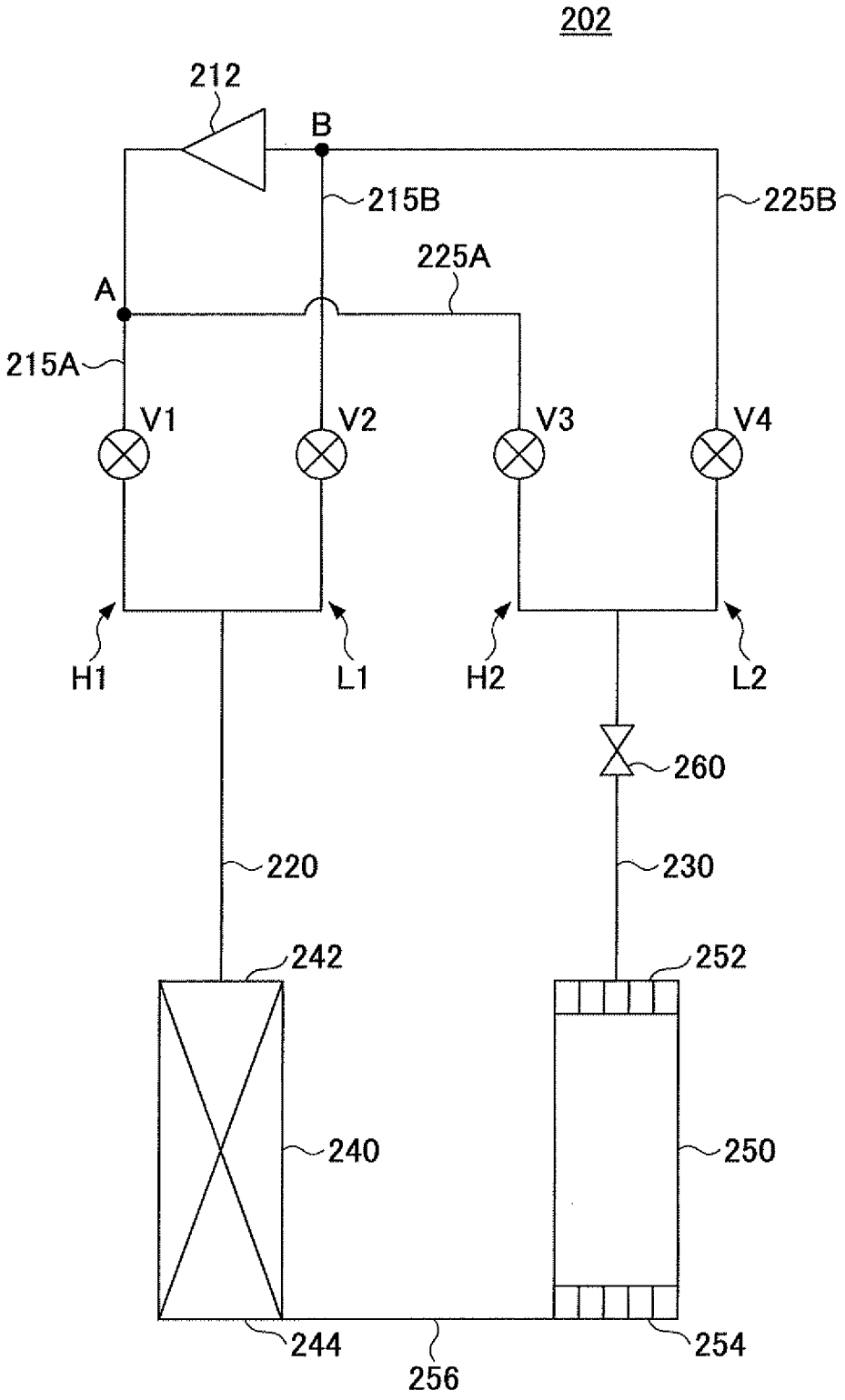
FIG. 10 is a structure diagram of a four-valve type pulse tube refrigerator according to a third embodiment of the present invention.

FIG. 10 is a structure diagram of the four-valve type pulse tube refrigerator according to the third embodiment of the present invention. The four-valve type pulse tube refrigerator 202 according to the third embodiment is of a single-stage type. In FIG. 10, parts that are the same as the parts illustrated in FIG. 3 are given the same reference numerals, and descriptions thereof will be omitted.

As illustrated in FIG. 10, the four-valve type pulse tube refrigerator 202 according to the third embodiment is equipped with a compressor 212, a regenerator 240, a pulse tube 250, and pipes that are connected to those parts.

Figure 11:
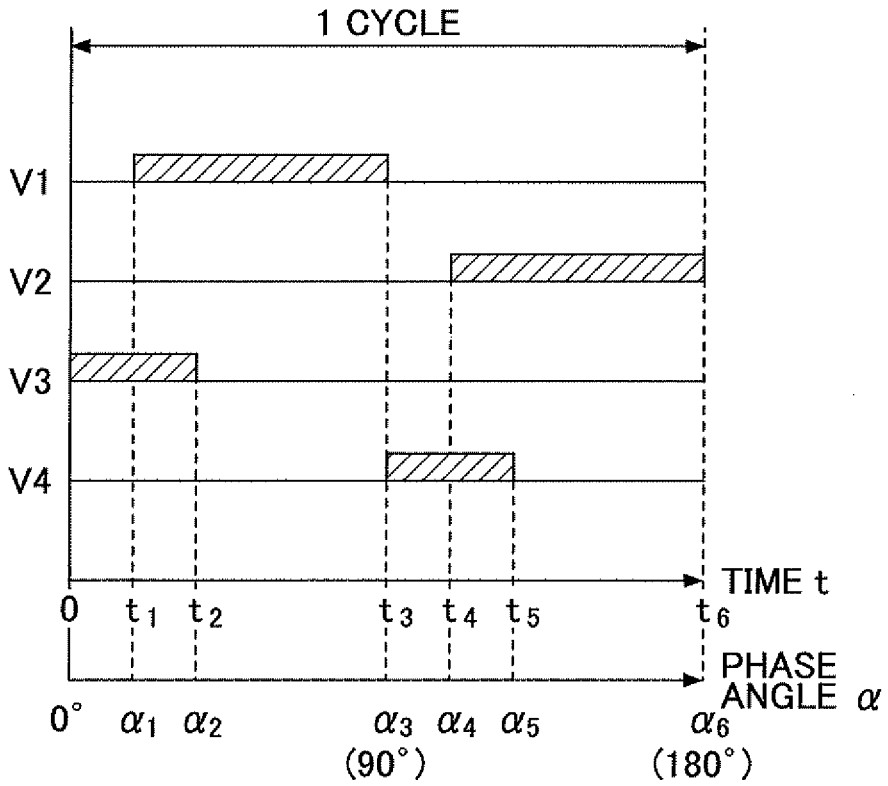
FIG. 11 is a time chart indicating open/close states of four on-off valves during an operation of the pulse tube refrigerator according to the third embodiment.

FIG. 11 is a time chart indicating open/close states of the four on-off valves V1 through V4 when the pulse tube refrigerator 202 is in operation. A description is given below of each process.

(First Process: Time 0-t3)

First, at a time t=0, only the on-off valve V3 is opened. Thereby, a high-pressure coolant gas is supplied from the compressor 212 to the pulse tube 250 through a second coolant supply path H2. Then, at a time t=t1, the on-off valve V1 is opened while the on-off valve V3 is maintained in the open state. Thereby, a high-pressure coolant gas is supplied from the compressor 212 to the regenerator 240 through a first coolant supply path H1. The coolant gas flowing into the regenerator 240 is cooled by a regenerative material provided in the regenerator. The cooled coolant gas flows into the pulse tube 250 through a first pipe 256. The coolant gas is subjected to a heat exchange by a heat exchanger provided at a low-temperature end 254.

Then, at a time t=t2, the on-off valve V3 is closed while the on-off valve V1 is maintained in the open state. Thereby, the supply of the high-pressure coolant gas to the pulse tube 250 is stopped. Then, at a time t=t3, the on-off valve V1 is closed, and, thereby, the supply of the high-pressure coolant gas to the regenerator 240 is stopped.

(Second Process: Time t3-t6)

Then, at a time t=t3, the on-off valve V4 is opened. Thereby, the coolant gas in the pulse tube 250 is returned to the compressor 212 via a second coolant recovery path L2. At a time t=t4, the on-off valve V2 is opened while the on-off valve V4 is maintained in the open state. Thereby, a low-pressure coolant gas is returned from the regenerator 240 to the compressor 212. Then, at a time t=t5, the on-off valve V4 is closed. Thereby, the path routing the second coolant recovery path L2 is closed. Further, at a time t=t6, the on-off valve V2 is closed, and, thereby, the path from the regenerator 240 and routing the first coolant recovery path L1 is closed. By repeating the above-mentioned cycle, a cooling object provided at the low-temperature end 254 of the pulse tube 250 is cooled.

Rotary Valve According to the Third Embodiment

A description will now be given, with reference to FIG. 12, of a structure of the rotary valve in order to perform the operations of the on-off valves V1 through V4 at a timing indicated in FIG. 11.

Figure 12:
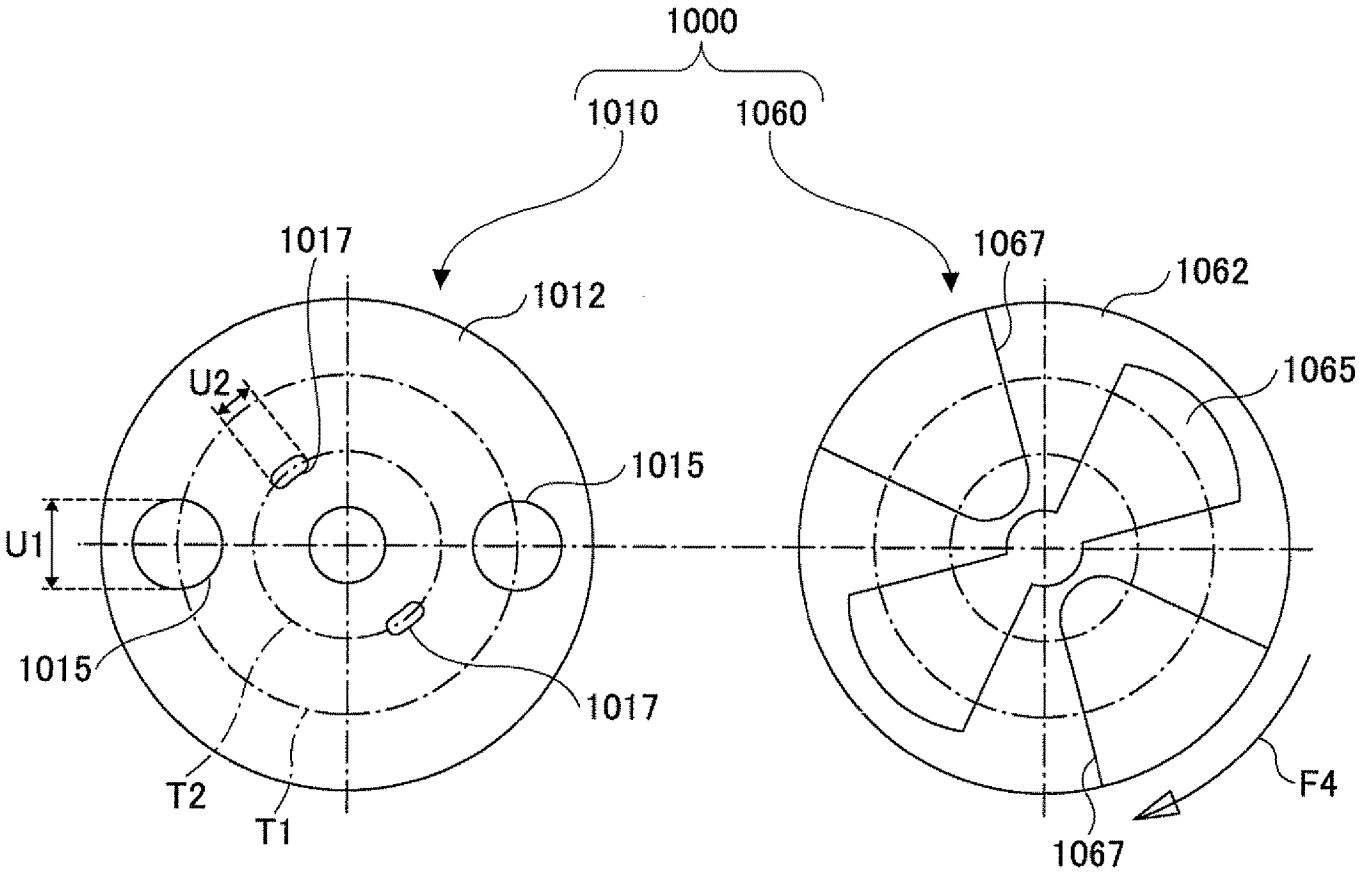
FIG. 12 is a plan view illustrating faces of a stationary seat and a rotary disk that constitute a rotary valve according to the third embodiment.

FIG. 12 is a plan view of faces 1012 and 1062 of a stationary seat 1010 and a rotary disk 1060 that constitute the rotary valve 1000 according to the third embodiment. The circular face 1012 of the stationary seat 1010 is illustrated on the left side of FIG. 12. The circular face 1062 of the rotary disk 1060, which is brought into surface-contact with the face 1012 of the stationary seat 1010, is illustrated on the right side of FIG. 12.

The face 1012 of the stationary seat 1010 illustrated in FIG. 12 is provided with two ports 1015 and two ports 1017. In the example illustrated in FIG. 12, each of the ports 1015 is substantially circular, and each of the ports 1017 has a substantially elongated circular shape, which is elongated in a circumferential direction of the face 1012. A diameter U1 of each of the ports 1015 is larger than a width U2 (an overall length in the circumferential direction of the face 1012) of each of the ports 1017.

The two ports 1015 play a role of supplying a high-pressure coolant gas, which is supplied from the first coolant supply path H1, to the regenerator 240, and exhausting a low-pressure coolant gas in the regenerator 240 toward the first low-pressure side pipe L1. Hereinafter, the two ports 1015 may be referred to as "regenerator ports 1015". The ports 1017 play a role of supplying a high-pressure coolant gas, which is supplied from the second coolant supply path H2, to the pulse tube 250, and exhausting a low-pressure coolant gas in the pulse tube 250 toward the second low-pressure side pipe L2. Hereinafter, the ports 1017 may be referred to as "pulse tube ports 1017".

As illustrated in FIG. 12, the two regenerator ports 1015 are located on a track T1. In other words, the centers of the regenerator ports 1015 are contained in a track area T1. Similarly, the two pulse tube ports 1017 are located on a track T2. In other words, the centers of the pulse tube ports 1015 are contained in a track area T2.

As apparent from FIG. 12, the two ports 1015 are located at positions which are substantially rotationally symmetrical with respect the center of the face 1012. Similarly, the two ports 1017 are located at positions which are substantially rotationally symmetrical with respect the center of the face 1012.

On the other hand, as illustrated in FIG. 12, the circular face 1062 of the rotary disk 1060 has one elongated circular hole 1065, which extends in a radial direction by passing through the center of the circular face 1062, and two small holes 1067, which extend toward the center from the outer peripheral end of the face 1062. The small holes 1067 are provided in the circular face 1062 so that they are rotationally symmetric with respect to the center of the circular face 1062. Hereinafter the elongated circular hole 1065 is referred to as "high-pressure flow path opening 1065" because it is a flow passage of a high-pressure coolant gas. The two small holes 1067 may be referred to as "low-pressure flow path openings 1067" because they are flow passages of a low-pressure coolant gas.

When the rotary valve 1000 is in operation, the face 1062 of the rotary disk 1060 rotates relative to the face 1012 of the stationary seat 1010. During an operation of the rotary valve 1000, when the high-pressure flow path opening 1065 and the low-pressure flow path openings 1067, which are provided on the face 1062 of the rotary disk 1060, reach and pass the ports 1015 and 1017 provided on the face 1012 of the stationary seat 1010, the coolant gas is caused to flow through the rotary valve 1000 at timings indicated in FIG. 11. In other words, the sizes and positions of the high-pressure flow path opening 1065 and the low-pressure flow path openings 1067, which are provided on the face 1062 of the rotary disk 1060, and the ports 1015 and 1017 provided on the face 1012 of the stationary seat 1010 are determined so that they are in a relative positional relationship with which a flow of the coolant gas is achieved at the timings indicated in FIG. 11 when the rotary disk 1060 rotates.

When the face 1062 of the rotary disk 1060 of the rotary valve 1000 rotates in a direction indicated by an arrow F4 of FIG. 12, a relationship (that is, a relationship between the rotation angle (phase angle) $\alpha$ and each of the on-off valves V1 through V4) indicated in FIG. 11 is obtained according to a relative positional relationship between each port of the stationary seat 1010 and each opening of the rotary disk 1060. Thus, a description of the relationship between the rotation angle and an opening and closing timing of each valve will be omitted. The structure of the rotary valve 1000 illustrated in FIG. 12 corresponds to a "one-rotation two-cycle system".

Also in the third embodiment, similar to the first and second embodiments, a diameter of the faces can be reduced and the rotary valve can be miniaturized.

Fourth Embodiment

A description will now be given, with reference to FIG. 12, of a structure of a rotary valve 1100 in order to perform the operations of the on-off valves V1 through V4 at a timing indicated in FIG. 11.

Figure 13:
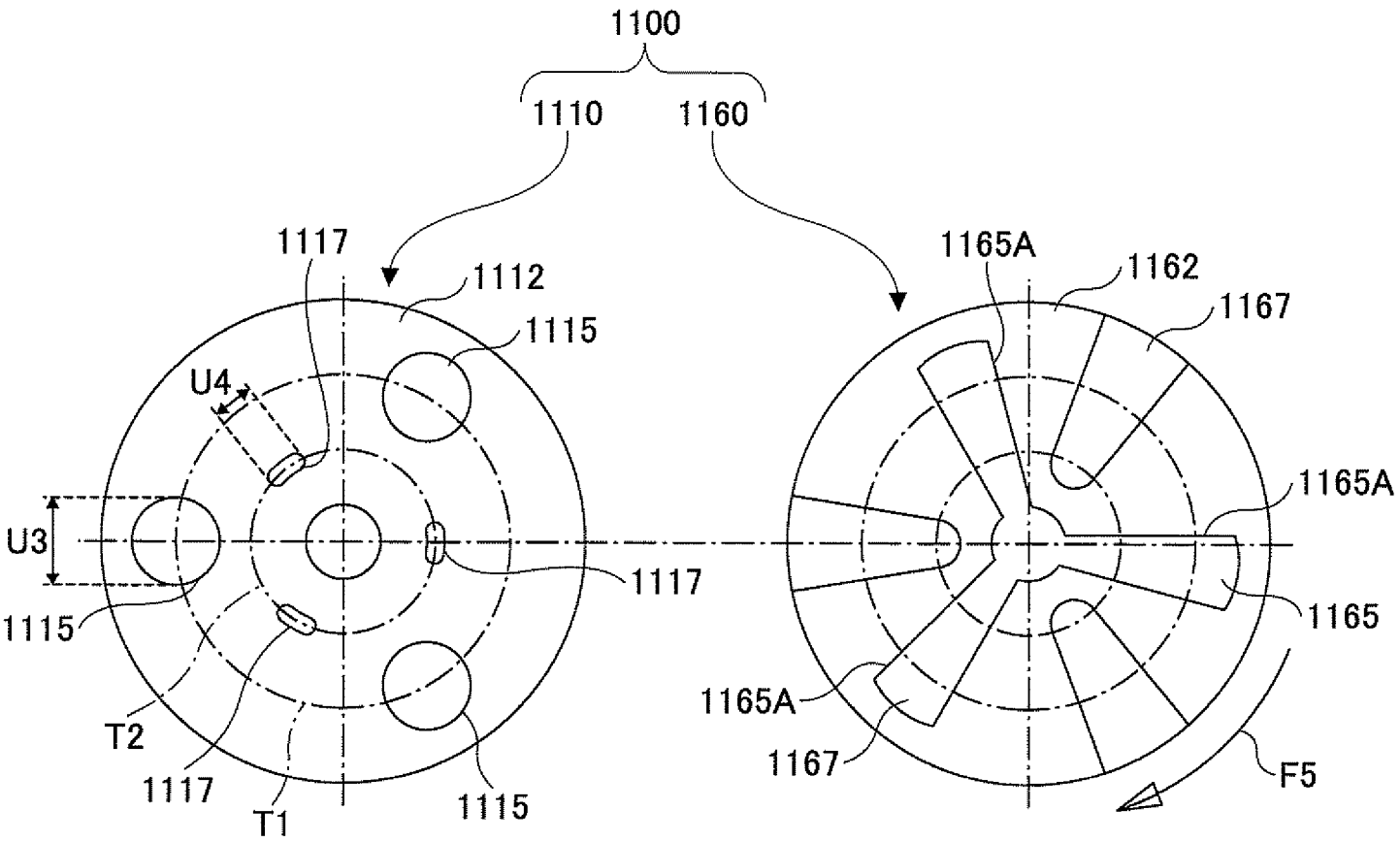
FIG. 13 is a plan view illustrating faces of a stationary seat and a rotary disk that constitute a rotary valve according to a fourth embodiment.

FIG. 13 is a plan view of faces 1112 and 1162 of a stationary seat 1110 and a rotary disk 1160 that constitute the rotary valve 1100 according to the fourth embodiment. The circular face 1112 of the stationary seat 1110 is illustrated on the left side of FIG. 13. The circular face 1162 of the rotary disk 1160, which is brought into surface-contact with the face 1112 of the stationary seat 1110, is illustrated on the right side of FIG. 13.

The face 1112 of the stationary seat 1110 illustrated in FIG. 13 is provided with three ports 1115 and three ports 1117. In the example illustrated in FIG. 13, each of the ports 1115 is substantially circular, and each of the ports 1117 has a substantially elongated circular shape, which is elongated in a circumferential direction of the face 1112. A diameter U3 of each of the ports 1115 is larger than a width U4 (an overall length in the circumferential direction of the face 1112) of each of the ports 1117.

The three ports 1115 are regenerator ports, and play a role of supplying a high-pressure coolant gas, which is supplied from the first coolant supply path H1, to the regenerator 240, and exhausting a low-pressure coolant gas in the regenerator 240 toward the first low-pressure side pipe L1. The three ports 1117 are pulse tube ports, and play a role of supplying a high-pressure coolant gas, which is supplied from the second coolant supply path H2, to the pulse tube 250, and exhausting a low-pressure coolant gas in the pulse tube 250 toward the second low-pressure side pipe L2.

As illustrated in FIG. 13, the three regenerator ports 1115 are located on the track T1. In other words, the centers of the regenerator ports 1115 are contained in the track area T1. Similarly, the three pulse tube ports 1117 are located on the track T2. In other words, the centers of the pulse tube ports 1117 are contained in the track area T2.

As apparent from FIG. 13, the three ports 1115 are located at positions which are substantially rotationally symmetrical with respect the center of the face 1112. Similarly, the three ports 1117 are located at positions which are substantially rotationally symmetrical with respect the center of the face 1112.

On the other hand, as illustrated in FIG. 13, the circular face 1162 of the rotary disk 1160 has one high-pressure flow path opening 1165 and three low-pressure flow path openings 1167. The high-pressure flow path opening 1165 has three wing parts 1165A extending in three directions from the center of circular face 1162. The wing parts 1165A extend in radial directions so that an angle formed between the adjacent wing parts 1165A is 120 degrees. The three low-pressure flow path openings 1167 are provided between the wing parts 1165A of the high-pressure flow path opening 1165 so that the low-pressure flow path openings 1167 are rotationally symmetric with respect to the center of the circular face 1162.

When the rotary valve 1100 is in operation, the face 1162 of the rotary disk 1160 rotates relative to the face 1112 of the stationary seat 1110. During an operation of the rotary valve 1100, when the high-pressure flow path opening 1165 and the low-pressure flow path openings 1167, which are provided on the face 1162 of the rotary disk 1160, reach and pass the ports 1115 and 1117 provided on the face 1112 of the stationary seat 1110, the coolant gas is caused to flow through the rotary valve 1100 at timings indicated in FIG. 11. In other words, the sizes and positions of the high-pressure flow path opening 1165 and the low-pressure flow path openings 1167, which are provided on the face 1162 of the rotary disk 1160, and the ports 1115 and 1117 provided on the face 1112 of the stationary seat 1110 are determined so that they are in a relative positional relationship with which a flow of the coolant gas is achieved at the timings indicated in FIG. 11 when the rotary disk 1160 rotates.

When the face 1162 of the rotary disk 1160 of the rotary valve 1100 rotates in a direction indicated by an arrow F5 of FIG. 13, a relationship (that is, a relationship between the rotation angle (phase angle) $\alpha$ and each of the on-off valves V1 through V4) indicated in FIG. 11 is obtained according to a relative positional relationship between each port of the stationary seat 1110 and each opening of the rotary disk 1160. Thus, a description of the relationship between the rotation angle and an opening and closing timing of each valve will be omitted. The structure of the rotary valve 1100 illustrated in FIG. 13 corresponds to a "one-rotation three-cycle system".

Also in the fourth embodiment, similar to the first through third embodiments, the diameter of the faces can be reduced and the rotary valve can be miniaturized.

In the above-mentioned first through fourth embodiments, an area of the faces of the rotary valve is reduced by arranging a plurality of ports of the face of the rotary valve within two track areas and arranging the plurality of ports at rotationally symmetric positions. However, the area of the faces of the rotary valve can be reduced by locating a plurality of ports within one track area as explained below.

Fifth Embodiment

A description will now be given of a four-valve type pulse tube refrigerator according to a fifth embodiment of the present invention.

The four-valve type pulse tube refrigerator according to the fifth embodiment of the present invention has the same structure as the four-valve type pulse tube refrigerator illustrated in FIG. 3, and a description of the entire structure will be omitted.

A description will be given below, with reference to FIG. 14, of a structure of a rotary valve according to the fifth embodiment of the present invention, which achieves a function of each of on-off valves V1 through V6 at timings indicated in FIG. 4.

Figure 14:
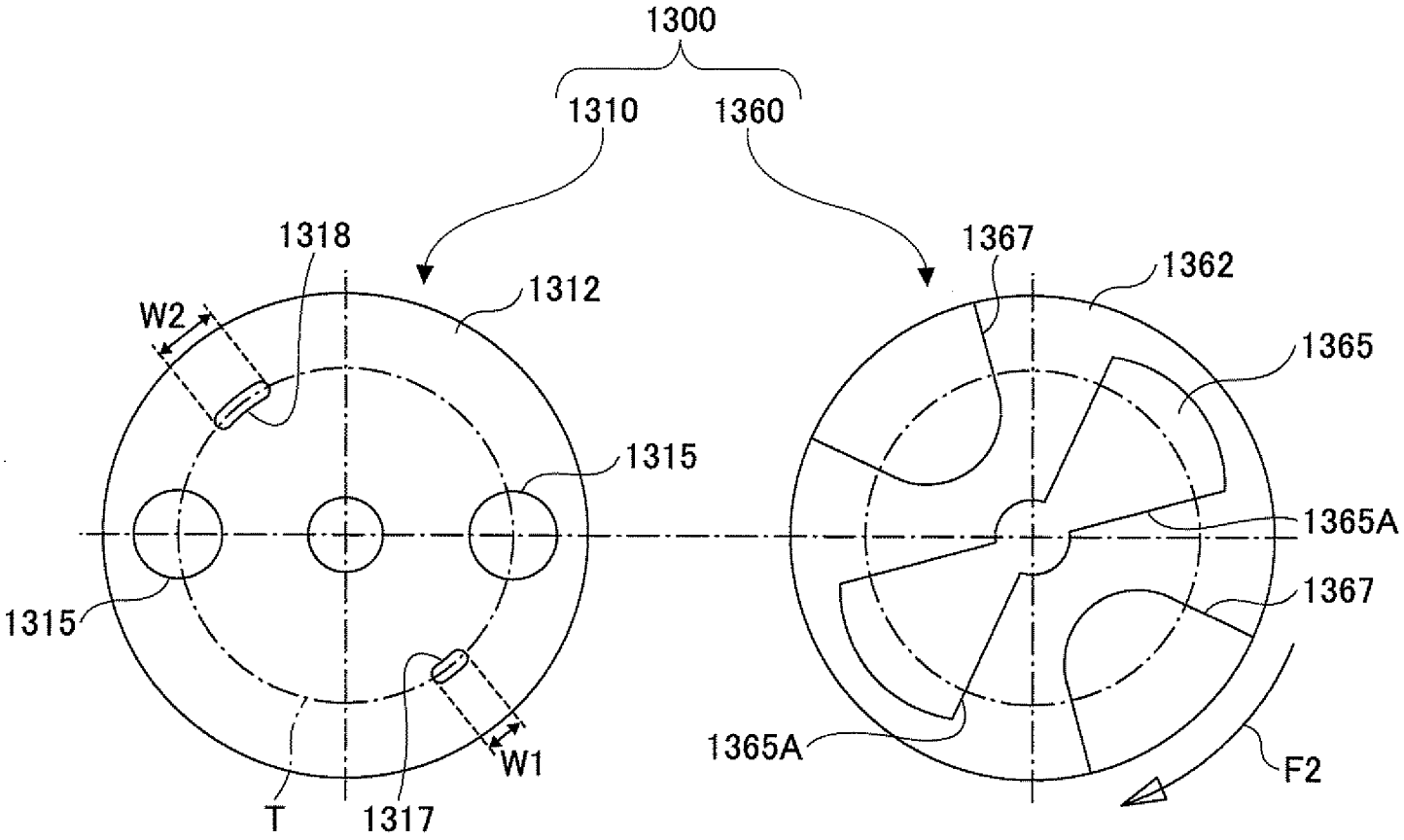
FIG. 14 is a plan view illustrating faces of a stationary seat and a rotary disk that constitute a rotary valve according to a fifth embodiment.

FIG. 14 is a plan view of faces 1312 and 1362 of a stationary seat 1310 and a rotary disk 1360 that constitute the rotary valve 1300 according to the fifth embodiment of the present invention. The circular face 1312 of the stationary seat 1310 is illustrated on the left side of FIG. 14. The circular face 1362 of the rotary disk 1360, which is brought into surface-contact with the face 1312 of the stationary seat 1310, is illustrated on the right side of FIG. 14.

The face 1312 of the stationary seat 1310 illustrated in FIG. 14 is provided with two ports 1315 and one port 1317 and one port 1318. In the example illustrated in FIG. 14, each of the ports 1315 is substantially circular, and each of the ports 1317 and 1318 has a substantially elongated circular shape, which is elongated in a circumferential direction of the face 1312. A width W2 (an overall length in a circumferential direction of the face 1312) is larger than a width W1 (an overall length in the circumferential direction of the face 1312) of the ports 1317.

The two ports 1315 play a role of supplying a high-pressure coolant gas, which is supplied from the first coolant supply path H1, to the regenerators 240 and 280, and exhausting a low-pressure coolant gas in the regenerators 240 and 280 toward the first low-pressure side pipe L1 through the rotary disk 1360. Hereinafter, the two ports 1315 may be referred to as "regenerator ports 1315". The port 1317 plays a role of supplying a high-pressure coolant gas, which is supplied from the second coolant supply path H2 through the rotary disk 1360, to the first-stage pulse tube 250, and exhausting a low-pressure coolant gas in the first-stage pulse tube 250 toward the second low-pressure side pipe L2. Hereinafter, the port 1317 may be referred to as "first-stage pulse tube port 1317". The port 1318 plays a role of supplying a high-pressure coolant gas, which is supplied from the third high-pressure coolant supply path H3 through the rotary disk 1360, to the second-stage pulse tube 290, and exhausting a low-pressure coolant gas in the second-stage pulse tube 290 toward the third low-pressure side pipe L3 through the rotary disk 1360. Hereinafter, the port 1318 may be referred to as "second-stage pulse tube port 1318".

As illustrated in FIG. 14, the two ports 1315 are located at positions which are substantially rotationally symmetrical with respect the center of the face 1312. Similarly, the ports 1317 and 1318 are located at positions which are substantially rotationally symmetrical with respect the center of the face 1312.

The four ports (two regenerator ports 1315, the first-stage pulse tube port 1317 and the second pulse tube port 1318) are on a track of the same distance (radius) from the center of the circular face 1312 of the stationary seat 1310. Hereinafter, the track of the same distance from the center of the circular face 1311 is referred to as track T.

The circular face 1362 of the rotary disk 1360 illustrated in FIG. 14 has one elongated hole 1365, which extends in a radial direction by passing through the center of the circular face 1362, and two small holes 1367, which extend toward the center from the outer peripheral end of the face 1362. The small holes 1367 are provided in the circular face 1362 so that they are rotationally symmetric with respect to the center of the circular face 1362. Hereinafter the elongated hole 1365 is referred to as "high-pressure flow path opening 1365" because it is a flow passage of a high-pressure coolant gas. The two small holes 1367 may be referred to as "low-pressure flow path openings 1367" because they are flow passages of a low-pressure coolant gas.

A passage of a high-pressure coolant gas is open at the center of the face 1362 of the rotary disk 1360 illustrated in FIG. 14. This passage is communicated with the high-pressure flow path opening 1365. Additionally, a space for a low-pressure coolant gas is formed outside the face 1362 of the rotary disk 1360. The low-pressure flow path openings 1367 are communicated with this space.

When the rotary valve 1300 is in operation, the face 1362 of the rotary disk 1360 rotates relative to the face 1312 of the stationary seat 1310. During an operation of the rotary valve 1300, when the high-pressure flow path opening 1365 and the low-pressure flow path openings 1367, which are provided on the face 1362 of the rotary disk 1360, reach and pass the ports 1315, 1317 and 1318 provided on the face 1312 of the stationary seat 1310, the coolant gas is caused to flow through the rotary valve 1300 at timings indicated in FIG. 4. In other words, the sizes and positions of the high-pressure flow path opening 1365 and the low-pressure flow path openings 1367, which are provided on the face 1362 of the rotary disk 1360, and the ports 1315, 1317 and 1318 provided on the face 1312 of the stationary seat 1310 are determined so that they are in a relative positional relationship with which a flow of the coolant gas is achieved at the timings indicated in FIG. 4 when the rotary disk 1360 rotates in a direction indicated by an arrow F2 of FIG. 14.

A description will be given below, with reference to FIG. 4, of a relationship between a rotational angle (phase angle) $\alpha$ of the rotary disk 1360 of the rotary valve 1300 and opening and closing of the valves V1 through V6 illustrated in FIG. 3.

(Phase Angle $\alpha$=0°-90°)

First, when the high-pressure flow path opening 1365 of the rotary disk 1360 is brought into communication with the second-stage pulse tube port 1318 of the stationary seat 1310, a high-pressure coolant gas is introduced into the second-stage pulse tube 290. This corresponds to a state (time t=0) where the valve V5 is opened in FIG. 4. When the rotary disk 1360 rotates further ($\alpha$=$\alpha$1), the high-pressure flow path opening 1365 of the rotary disk 1360 is also brought into communication with the first-stage pulse tube port 1317 of the stationary seat 1310, thereby introducing the high-pressure coolant gas into the first-stage pulse tube 250. This corresponds to a state (time t=t1) where the valve V3 is opened in FIG. 4. When the rotary disk 1360 rotates further ($\alpha$=$\alpha$2), the high-pressure flow path opening 1365 of the rotary disk 1360 is also brought into communication with the regenerator ports 1315 of the stationary seat 1310, thereby introducing the high-pressure coolant gas into the regenerator 240. This corresponds to a state (time t=t2) where the on-off valve V1 is opened in FIG. 4.

Thereafter, when the face 1362 of the rotary disk 1360 rotates further, the high-pressure flow path opening 1365 is brought into noncommunication with the first-stage pulse tube port 1317 at the phase angle α=α3, and the high-pressure flow path opening 1365 is brought into noncommunication with the second-stage pulse tube port 1318 at the phase angle α=α4. Accordingly, the supply of the high-pressure coolant gas to the first-stage pulse tube 250 and the second-stage pulse tube 290 is stopped (corresponding to closing of the on-off valves V3 and V5). Further, when the phase angle α reaches 90° (α=α5), the supply of the high-pressure coolant gas to the regenerator 240 is also stopped (corresponding to closing of the on-off valve V1).

(Phase Angle α=90°-180°)

On the other hand, at the phase angle α=α5 (90°), the low-pressure flow path opening 1367 is brought into communication with the second-stage pulse tube port 1318 of the stationary seat 1310, and, thereby, an exhaust of a low-pressure coolant gas from the second-stage pulse tube 290 is started (corresponding to opening of the on-off valve V6). Additionally, at the phase angles of α=α6 and α=α7, the low-pressure flow path 1367 of the rotary disk 1360 is sequentially brought into communication with the first-stage pulse tube port 1318 and the regenerator ports 1315 (corresponding to opening of the on-off valves V4 and V2, respectively). Thereby, an exhaust of the low-pressure coolant gas from the first-stage pulse tube 250 and the regenerators 240 and 280 is started.

Then, at the phase angle α=α8, the low-pressure flow path 1367 of the rotary disk 1360 is brought into noncommunication with the first-stage pulse tube port 1317, and, thereby, the exhaust of the low-pressure coolant gas from the first-stage pulse tube 250 is stopped (corresponding to closing of the on-off valve V4). At the phase angle α=α9, the low-pressure flow path 1367 of the rotary disk 1360 is also brought into noncommunication with the second-stage pulse tube port 1318, and, thereby, the exhaust of the low-pressure coolant gas from the second-stage pulse tube 290 is stopped (corresponding to closing of the on-off valve V6).

Finally, at the phase angle α=α10, the low-pressure flow path 1367 of the rotary disk 1360 is also brought into noncommunication with the regenerator ports 1315 of the stationary seat 1310, and, thereby, the exhaust of the low-pressure coolant gas from the regenerators 240 and 280 is stopped (corresponding to closing of the on-off valve V2).

One cycle of the above-mentioned cooling cycle is completed by 180°-rotation of the rotary disk 1360. Accordingly, in the case of the rotary valve 1300 as illustrated in FIG. 14, one complete rotation of the rotary disk 1360 corresponds to two cycles of the cooling cycle.

As mentioned above, in the rotary valve R1 illustrated in FIG. 2, at least three tracks TA1, TA2 and TA3 are needed in the face R12 of the stationary seat R10. Accordingly, there is a limitation in reducing the size of the rotary valve R1.

On the other hand, in the rotary valve 1300 according to the present embodiment, the number of tracks in the face 1312 of the stationary seat 1310 is reduced to one. Therefore, the diameter of the face 1312 of the stationary seat 1310 can be reduced. Thereby, the rotary valve 1300 can be miniaturized, and a torque needed for rotating the rotary disk 360 can be reduced. Moreover, because the face 1312 of the stationary seat 310 and the face 1362 of the rotary disk 1360 are made smaller, there is an effect provided that an amount of abrasion particles generated due to wear of both the faces 1312 and 1362 can be reduced.

Further, in the rotary valve 1300 according to the present embodiment, the two ports 1315 are arranged at substantially rotation symmetric positions with respect to the center of the face 1312 of the stationary seat 1310. Moreover, ports 1317 and 1318 are arranged at substantially rotation symmetric positions with respect to the center of the face 1312 of the stationary seat 1310.

Therefore, in the rotary valve 1300 according to the present embodiment, both the faces 1312 and 1362 are in surface-contact with each other stably during the rotation of the rotary disk 1360, thereby suppressing generation of a gap between the faces 1312 and 1362 or, on the contrary, suppressing a hard contact of the faces 1312 and 1362 with each other. Thus, a stable operation of the rotary valve 1300 can be achieved, and generation of abrasion particles due to wear of the faces 1312 and 1362 can be suppressed. Further, a multivalve type pulse tube refrigerator equipped with such a rotary valve can maintain a stable cooling characteristic for a long time.

It should be noted that the shapes of the ports and the holes and the relative positional relationship illustrated in FIG. 14 are mere examples, and the present invention is applicable to a rotary valve with different shapes of the ports and the holes and different relative positional relationship.

As mentioned above, the present embodiment provides the following two features.

(i) The first track TA1 for the ports R15 to supply a high-pressure coolant gas to the regenerator 40 and exhaust a low-pressure gas from the regenerator 40, the second track TA2 for the ports T17 and R18 to supply a high-pressure coolant gas to the pulse tubes 50 and 90, and the third track TA3 for the ports R27 and R28 to exhaust a low-pressure coolant gas from the pulse tubes 50 and 90 are integrated into one track in order to reduce the number of tracks to one.

(ii) In the single track T, two cold-accumulating ports 1315 are arranged at a position rotationally symmetric with respect to the center of the face 1312, and the first-stage pulse tube port 1317 and the second-stage pulse tube port 1318 are arranged at positions rotationally symmetric with respect to the center of the face 1312.

Moreover, in the present embodiment, a so-called "one-rotation two-cycle system" is explained in which one rotation of the rotary disk 1360 corresponds to two cycles of the cooling cycle. However, the present invention is not limited to the "one-rotation two-cycle system" and is applicable to other systems such as "one-rotation three-cycle system".

In the present embodiment, the center of each of the four ports 1315, 1317 and 1318 is not necessarily arranged on the line of the track T, which is at the same distance from the center of the face 1312. A description is given below of such a "track" or a "track area".

Figure 15:
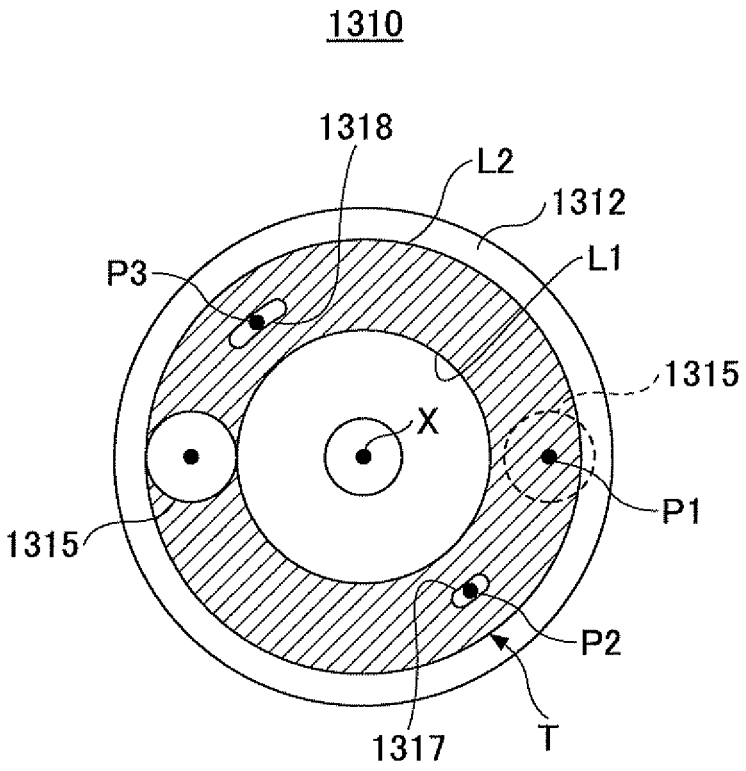
FIG. 15 is an illustration of the face of the stationary seat for explaining a concept of a "track area"

FIG. 15 is an illustration of the face 1312 of the stationary seat 1310 for explaining the concept of the "track area". The "track area" (the track T) is defined as follows.

First, one of the two cold-accumulating ports 1315, the first-stage pulse tube port 1317 and the second-stage pulse tube port 1318, which has a largest size in a radial direction of the face 1312, is selected (in the example illustrated in FIG. 15, each of the regenerator ports 1315 is largest; for the sake of convenience, the cold-accumulating port 1315 on the left side is selected). Then, concentric circles L1 and L2 having the center as the center X of the face 1312 are drawn so that the selected port is just contained in an area between the circles L1 and L2 (L1<L2). The thus-obtained area between the concentric circles L1 and L2 (a hatched portion in FIG. 15) is the "track area".

Then, if the centers P1-P3 (if the shapes of the ports are not circles, but other shapes such as ovals, the centers in a radial direction of the face 1312) are located within the "track area", it can be said that each of the ports 1315, 1317 and 1318 are on the same (single) track.

Sixth Embodiment

A description will now be given, with reference to FIG. 16 and FIGS. 7 and 8, of a sixth embodiment of the present invention.

A pulse tube refrigerator according to the sixth embodiment of the present invention has the same structure as the pulse tube refrigerator 201 illustrated in FIG. 7 except that the rotary valve is different, and a description of an entire structure will be omitted. Additionally, an operation of the pulse tube refrigerator is the same as the operation explained with reference to FIG. 8, and a description thereof will be omitted.

A description will now be given, with reference to FIG. 16, of a structure of the rotary valve according to the sixth embodiment in order to perform the operations of the on-off valves V1 through V8 at timings indicated in FIG. 8.

Figure 16:
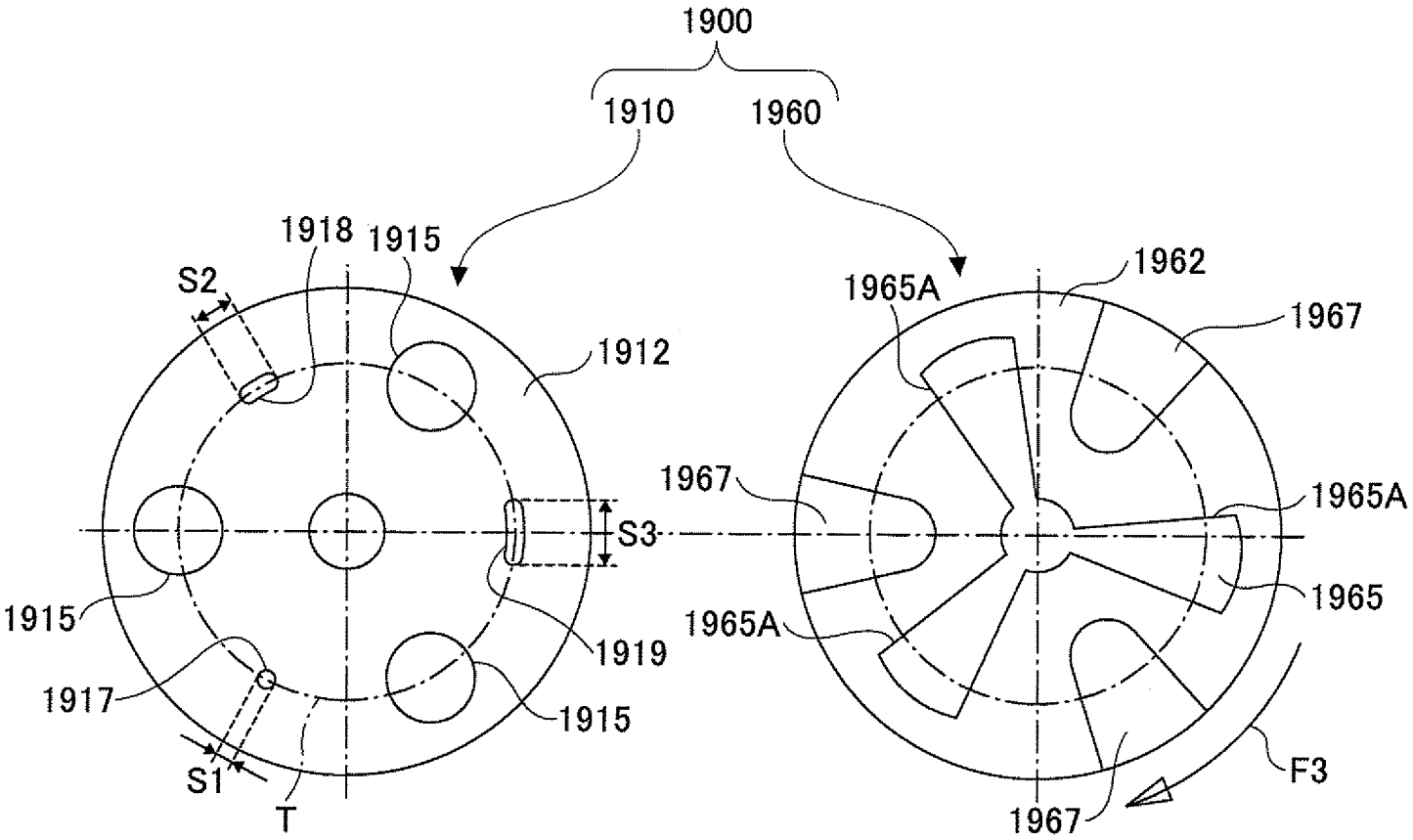
FIG. 16 is a plan view illustrating faces of a stationary seat and a rotary disk that constitute a rotary valve according to a sixth embodiment.

FIG. 16 is a plan view of faces 1912 and 1962 of a stationary seat 1910 and a rotary disk 1960 that constitute the rotary valve 1900 according to the sixth embodiment. The circular face 1912 of the stationary seat 1910 is illustrated on the left side of FIG. 16. The circular face 1962 of the rotary disk 1960, which is brought into surface-contact with the face 1912 of the stationary seat 1910, is illustrated on the right side of FIG. 16.

The face 1912 of the stationary seat 1910 illustrated in FIG. 16 is provided with ports 1915, 1917, 1918 and 1919. In the example of FIG. 16, each of the ports 1915 and 1917 is a substantially circular shape, and each of the ports 1918 and 1919 has a substantially elongated circular shape which is elongated in a circumferential direction of the face 1912. In the example of FIG. 16, a width S3 (an overall length in a circumferential direction of the face 1912) is larger than a width S2 (an overall length in a circumferential direction of the face 1912) of the port 1918. A width S2 of the port 1918 is larger than a diameter S1 of the port 1917. A diameter of each of the ports 1915 is larger than the width S3 of the port 1919.

The three ports 1915 play a role of supplying a high-pressure coolant gas from the first coolant supply path H1 to the regenerators 240, 280 and 440, and exhausting a low-pressure coolant gas from the regenerators 240, 280 and 440 to the first low-pressure side pipe L1. Hereinafter, the three ports 1915 are referred to as "regenerator ports 1915". The port 1917 plays a role of supplying a high-pressure gas from the second coolant supply path H2 to the first-stage pulse tube 250, and exhausting a low-pressure gas inside the first-stage pulse tube 250 to the second low-pressure side pipe L2. Hereinafter, the port 1917 is referred to as "first-stage pulse tube port 1917". The port 1918 plays a role of supplying a high-pressure gas from the third coolant supply path H3 to the second-stage pulse tube 290, and exhausting a low-pressure gas inside the second-stage pulse tube 290 to the third low-pressure side pipe L3. Hereinafter, the port 1918 is referred to as "second-stage pulse tube port 1918". The port 1919 plays a role of supplying a high-pressure gas from the fourth coolant supply path H4 to the third-stage pulse tube 420, and exhausting a low-pressure gas inside the third-stage pulse tube 420 to the fourth low-pressure side pipe L4. Hereinafter, the port 1919 is referred to as "third-stage pulse tube port 1919".

As illustrated in FIG. 16, all ports are on the track T. In other words, the center of each of the three regenerator ports 1915, the first-stage pulse tube port 1917, the second-stage pulse tube pot 1918 and the third-stage pulse tube port 1919 is contained in the track area T.

On the other hand, the circular face 1962 of the rotary disk 1960 has one high-pressure flow path opening 1965 and three low-pressure flow path openings 1967. The high-pressure flow path opening 1965 includes three wing parts 1965A extending in three directions. The wing parts 1965A extend in radial directions so that an angle formed between the adjacent wing parts 1965A is 120 degrees. The three low-pressure flow path openings 1967 are arranged between the wing parts 1965A of the high-pressure flow path opening 1965 so that they are substantially rotation symmetric with each other with respect to the circular face 1962.

During an operation of the rotary valve 1900, the face 1962 of the rotary disk 1960 rotates with respect to the face of the stationary seat 1910. During the rotation, the high-pressure flow path opening 1965 and the low-pressure flow path opening 1967 provided in the face 1962 of the rotary disk 1960 pass the ports 1915, 1917, 1918 and 1919 provided in the face 1912 of the stationary seat 1910, which results in a flow of the coolant gas at timings indicated in FIG. 8. In other words, the high-pressure flow path opening 1965 and the low-pressure flow path opening 1967 of the face 1962 of the rotary disk 1960 and the ports 1915, 1917, 1918 and 1919 of the face 1912 of the stationary seat 1910 are configured and arranged so that a coolant gas flow is achieved at timings indicated in FIG. 8 when the rotary disk 1960 is rotated.

When the face 1962 of the rotary disk 1960 of the rotary valve 1900 rotates in a direction indicated by an arrow F3 of FIG. 16, the relationship indicated in FIG. 8 (that is, the relationship between the rotation angle (phase angle) $\alpha$ and the on-off valves V1 through V8) is acquired according to the relative positional relationship of each ports of the stationary seat 1910 and each port of the rotary disk 1960. Thus, a description of the rotation angle and the relationship of the on-off valves are omitted. The structure of the rotary valve 1900 illustrated in FIG. 16 corresponds to a "one-rotation three-cycle system".

Also in the sixth embodiment, an effect the same as the fifth embodiment is obtained. That is, also according to the second embodiment, a reduction in a diameter of the faces and miniaturization of the rotary valve can be achieved.

Seventh Embodiment

A description will now be given of a four-valve type pulse tube refrigerator according to a seventh embodiment of the present invention.

A pulse tube refrigerator according to the seventh embodiment of the present invention has the same structure as the pulse tube refrigerator 202 illustrated in FIG. 10 except that the rotary valve is different, and a description of an entire structure thereof will be omitted. Additionally, an operation of the pulse tube refrigerator is the same as the operation explained with reference to FIG. 11, and a description thereof will be omitted.

A description will now be given, with reference to FIG. 17, of a structure of the rotary valve according to the seventh embodiment in order to perform the operations of the on-off valves V1 through V8 at timings indicated in FIG. 11.

Figure 17:
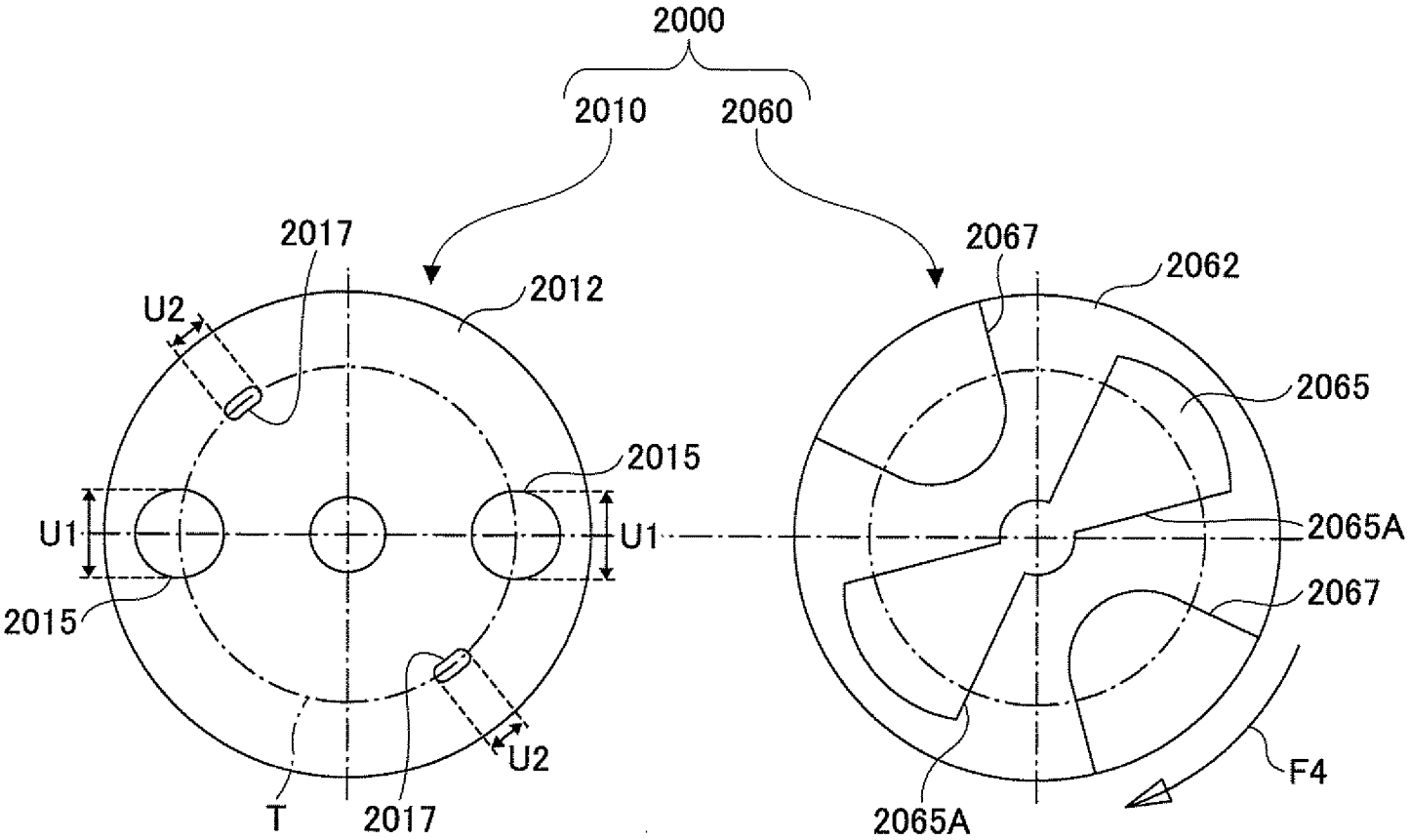
FIG. 17 is a plan view illustrating faces of a stationary seat and a rotary disk that constitute a rotary valve according to a seventh embodiment.

FIG. 17 is a plan view of faces 2012 and 2062 of a stationary seat 2010 and a rotary disk 2060 that constitute the rotary valve 2000 according to the seventh embodiment. The circular face 2012 of the stationary seat 2010 is illustrated on the left side of FIG. 17. The circular face 2062 of the rotary disk 2060, which is brought into surface-contact with the face 2012 of the stationary seat 2010, is illustrated on the right side of FIG. 17.

The face 2012 of the stationary seat 2010 illustrated in FIG. 17 is provided with two ports 2015 and two ports 2017. In the example illustrated in FIG. 17, each of the ports 2015 is substantially circular, and each of the ports 2017 has a substantially elongated circular shape, which is elongated in a circumferential direction of the face 2012. A diameter U1 of each of the ports 2015 is larger than a width U2 (a length in the circumferential direction of the face 2012) of each of the ports 2017.

The two ports 2015 play a role of supplying a high-pressure coolant gas, which is supplied from the first coolant supply path H1, to the regenerator 240, and exhausting a low-pressure coolant gas in the regenerator 240 toward the first low-pressure side pipe L1. Hereinafter, the two ports 2015 may be referred to as "regenerator ports 2015". The ports 2017 play a role of supplying a high-pressure coolant gas, which is supplied from the second coolant supply path H2, to the pulse tube 250, and exhausting a low-pressure coolant gas in the pulse tube 250 toward the second low-pressure side pipe L2. Hereinafter, the ports 2017 may be referred to as "pulse tube ports 2017".

As illustrated in FIG. 17, the two regenerator ports 2015 are located on a track T1. In other words, the centers of the regenerator ports 2015 and the centers of the two pulse tube ports 2017 are contained in a track area T1.

As apparent from FIG. 17, the two ports 2015 are located at positions which are substantially rotationally symmetrical with respect the center of the face 2012. Similarly, the two ports 2017 are located at positions which are substantially rotationally symmetrical with respect the center of the face 2012.

On the other hand, as illustrated in FIG. 17, the circular face 2062 of the rotary disk 2060 has one elongated circular hole 2065, which extends in a radial direction by passing through the center of the circular face 2062, and two small holes 2067, which extend toward the center from the outer peripheral end of the face 2062. The small holes 2067 are provided in the circular face 2062 so that they are rotationally symmetric with respect to the center of the circular face 2062. Hereinafter the elongated circular hole 2065 is referred to as "high-pressure flow path opening 2065" because it is a flow passage of a high-pressure coolant gas. The two small holes 2067 may be referred to as "low-pressure flow path openings 2067" because they are flow passages of a low-pressure coolant gas.

When the rotary valve 2000 is in operation, the face 2062 of the rotary disk 2060 rotates relative to the face 2012 of the stationary seat 2010. During an operation of the rotary valve 2000, when the high-pressure flow path opening 2065 and the low-pressure flow path openings 2067, which are provided on the face 2062 of the rotary disk 2060, reach and pass the ports 2015 and 2017 provided on the face 2012 of the stationary seat 2010, the coolant gas is caused to flow through the rotary valve 2000 at timings indicated in FIG. 11. In other words, the sizes and positions of the high-pressure flow path opening 2065 and the low-pressure flow path openings 2067, which are provided on the face 2062 of the rotary disk 2060, and the ports 2015 and 2017 provided on the face 2012 of the stationary seat 2010 are determined so that they are in a relative positional relationship with which a flow of the coolant gas is achieved at the timings indicated in FIG. 11 when the rotary disk 2060 rotates.

When the face 2062 of the rotary disk 2060 of the rotary valve 2000 rotates in a direction indicated by an arrow F4 of FIG. 17, a relationship (that is, a relationship between the rotation angle (phase angle) $\alpha$ and each of the on-off valves V1 through V4) indicated in FIG. 11 is obtained according to a relative positional relationship between each port of the stationary seat 2010 and each opening of the rotary disk 2060. Thus, a description of the relationship between the rotation angle and an opening and closing timing of each valve will be omitted. The structure of the rotary valve 2000 illustrated in FIG. 17 corresponds to a "one-rotation two-cycle system".

Also in the seventh embodiment, similar to the fifth and sixth embodiments, a diameter of the faces can be reduced and the rotary valve can be miniaturized.

Eighth Embodiment

A description will now be given, with reference to FIG. 18, of a structure of a rotary valve 2100 in order to perform the operations of the on-off valves V1 through V4 at a timing indicated in FIG. 11.

Figure 18:
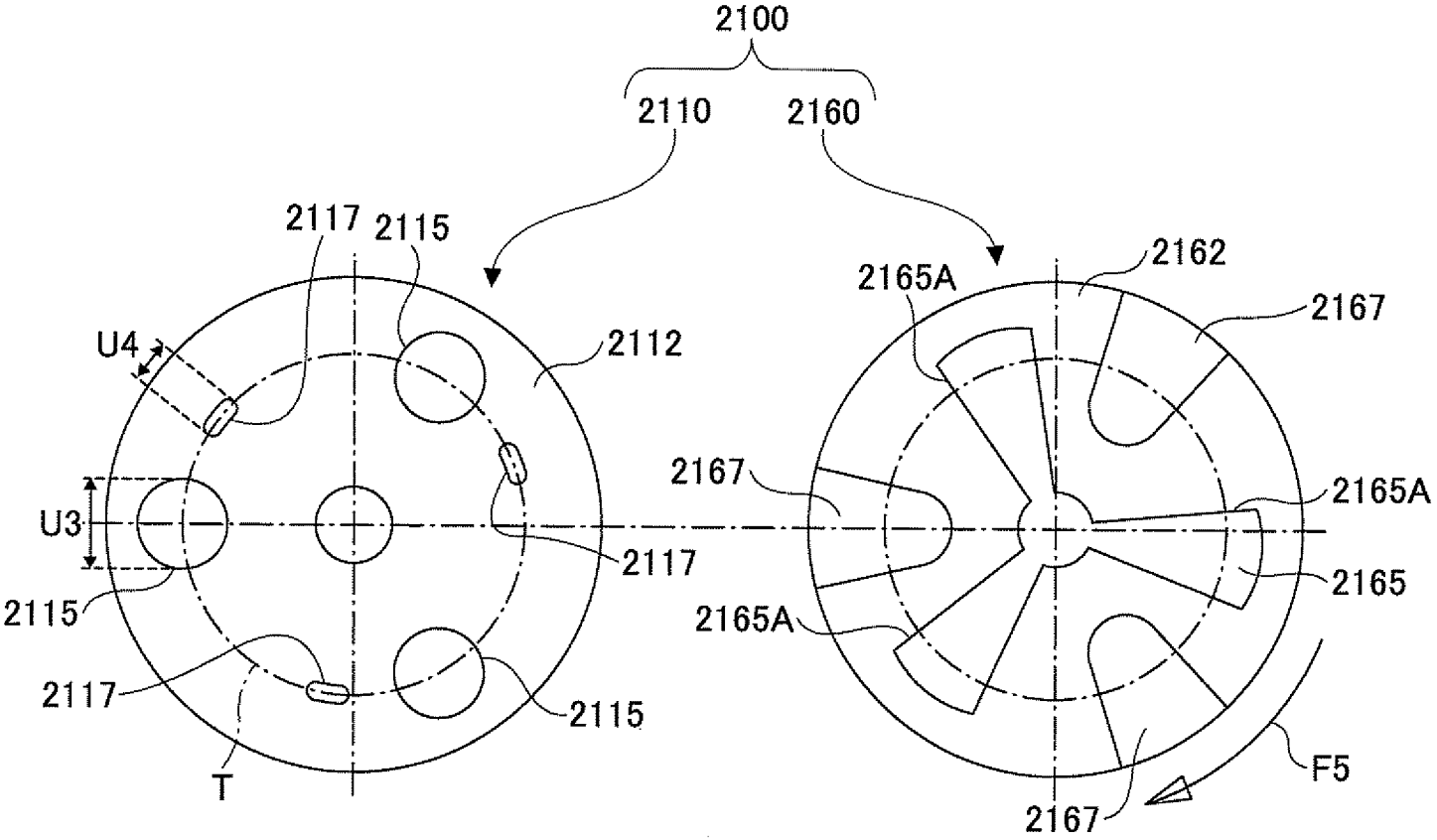
FIG. 18 is a plan view illustrating faces of a stationary seat and a rotary disk that constitute a rotary valve according to an eighth embodiment.

FIG. 18 is a plan view of faces 2112 and 2162 of a stationary seat 2110 and a rotary disk 2160 that constitute the rotary valve 2100 according to the eighth embodiment. The circular face 2112 of the stationary seat 2110 is illustrated on the left side of FIG. 18. The circular face 2162 of the rotary disk 2160, which is brought into surface-contact with the face 2112 of the stationary seat 2110, is illustrated on the right side of FIG. 18.

The face 2112 of the stationary seat 2110 illustrated in FIG. 18 is provided with three ports 2115 and three ports 2117. In the example illustrated in FIG. 18, each of the ports 2115 is substantially circular, and each of the ports 2117 has a substantially elongated circular shape, which is elongated in a circumferential direction of the face 2112. A diameter U3 of each of the ports 2115 is larger than a width U4 (an overall length in the circumferential direction of the face 2112) of each of the ports 2117.

The three ports 2115 are regenerator ports, and play a role of supplying a high-pressure coolant gas, which is supplied from the first coolant supply path H1, to the regenerator 240, and exhausting a low-pressure coolant gas in the regenerator 240 toward the first low-pressure side pipe L1. The three ports 2117 are pulse tube ports, and play a role of supplying a high-pressure coolant gas, which is supplied from the second coolant supply path H2, to the pulse tube 250, and exhausting a low-pressure coolant gas in the pulse tube 250 toward the second low-pressure side pipe L2.

As illustrated in FIG. 18, all of the ports 2115 and 2117 are located on the track T. In other words, the centers of the regenerator ports 2115 and the centers of the pulse tube ports 2117 are contained in the track area T.

As apparent from FIG. 18, the three ports 2115 are located at positions which are substantially rotationally symmetrical with respect the center of the face 2112. Similarly, the three ports 2117 are located at positions which are substantially rotationally symmetrical with respect the center of the face 2112.

On the other hand, as illustrated in FIG. 18, the circular face 2162 of the rotary disk 2160 has one high-pressure flow path opening 2165 and three low-pressure flow path openings 2167. The high-pressure flow path opening 2165 has three wing parts 2165A extending in three directions from the center of circular face 2162. The wing parts 2165A extend in radial directions so that an angle formed between the adjacent wing parts 2165A is 120 degrees. The three low-pressure flow path openings 2167 are provided between the wing parts 2165A of the high-pressure flow path opening 2165 so that the low-pressure flow path openings 2167 are rotationally symmetric with respect to the center of the circular face 2162.

When the rotary valve 2100 is in operation, the face 2162 of the rotary disk 2160 rotates relative to the face 2112 of the stationary seat 2110. During an operation of the rotary valve 2100, when the high-pressure flow path opening 2165 and the low-pressure flow path openings 2167, which are provided on the face 2162 of the rotary disk 2160, reach and pass the ports 2115 and 2117 provided on the face 2112 of the stationary seat 2110, the coolant gas is caused to flow through the rotary valve 2100 at timings indicated in FIG. 11. In other words, the sizes and positions of the high-pressure flow path opening 2165 and the low-pressure flow path openings 2167, which are provided on the face 2162 of the rotary disk 2160, and the ports 2115 and 2117 provided on the face 2112 of the stationary seat 2110 are determined so that they are in a relative positional relationship with which a flow of the coolant gas is achieved at the timings indicated in FIG. 11 when the rotary disk 2160 rotates.

When the face 2162 of the rotary disk 2160 of the rotary valve 2100 rotates in a direction indicated by an arrow F5 of FIG. 18, a relationship (that is, a relationship between the rotation angle (phase angle) $\alpha$ and each of the on-off valves V1 through V4) indicated in FIG. 11 is obtained according to a relative positional relationship between each port of the stationary seat 2110 and each opening of the rotary disk 2160. Thus, a description of the relationship between the rotation angle and an opening and closing timing of each valve will be omitted. The structure of the rotary valve 2100 illustrated in FIG. 18 corresponds to a "one-rotation three-cycle system".

Also in the eighth embodiment, similar to the fifth through seventh embodiments, the diameter of the faces can be reduced and the rotary valve can be miniaturized.

The present invention is not limited to the specifically disclosed embodiments, and variations and modifications may be made without departing from the scope of the present invention.

The present application is based on Japanese priority applications No. 2009-247060 filed Oct. 27, 2009 and No. 2009-247061 filed Oct. 27, 2009, the entire contents of which are incorporated herein by reference.

What is claimed is:

1. A rotary valve used for a multivalve type pulse tube refrigerator having a first stage pulse tube, a second stage pulse tube, and a regenerator, the rotary valve comprising:

a stationary seat having a face;

a rotary disk configured to change a coolant path by rotating while surface-contacting with the face of said stationary seat;

a plurality of regenerator ports provided in the face of said stationary seat in order to supply a high-pressure coolant to said regenerator and exhaust a low-pressure coolant from said regenerator;

a first-stage pulse tube port provided in the face of said stationary seat and connected to said first-stage pulse tube so as to supply the high-pressure coolant to said first stage pulse tube and exhaust the low-pressure coolant from said first-stage pulse tube; and a second-stage pulse tube port provided in the face of said stationary seat and connected to said second-stage pulse tube so as to supply the high-pressure coolant to said second-stage pulse tube and exhaust the low-pressure coolant from said second-stage pulse tube;

wherein all of said regenerator ports are arranged in a first circular track area having a first radius from a center of the face of said stationary seat in rotation symmetry with respect to the center of the face of said stationary seat, said first-stage pulse tube port and said second-stage pulse tube port are arranged in said first track area in rotation symmetry with respect to the center of the face of said stationary seat, each of said regenerator ports has a circular shape, each of said first-stage pulse tube port and said second-stage pulse tube port has an elongated circular shape, which is elongated in a circumferential direction of the face of said stationary seat.

2. The rotary valve according to claim 1, wherein a first opening for a high-pressure coolant to flow through and a second opening for a low-pressure coolant to flow through are arranged in a face of said rotary disk.

3. The rotary valve according to claim 2, wherein, when the face of said rotary disk rotates relative to the face of said stationary seat, said first opening is moved to a position at which said first opening is brought into communication with said second-stage pulse tube port before being brought into communication with said regenerator port, and/or said second opening is moved to a position at which said second opening is brought into communication with said second-stage pulse tube port before being brought into communication with said regenerator port.

4. The rotary valve according to claim 2, wherein, when the face of said rotary disk rotates relative to the face of said stationary seat, a time period during which said first opening is in communication with said regenerator port is longer than a time period during which said first opening is in communication with said second-stage pulse tube port, and/or a time period during which said second opening is in communication with said regenerator port is longer than a time period during which said second opening is in communication with said second-stage pulse tube port.

5. The rotary valve according to claim 2, wherein at least one of said first opening and said second opening has a spectral shape so that a width of the at least one of said first opening and said second opening along a circumferential direction of the face of said rotary disk increases toward an outer periphery of the face of said rotary disk.

6. The rotary valve according to claim 1, wherein one rotation of said rotary disk corresponds to more than two cycles of a cooling cycle of said pulse tube refrigerator.

7. The rotary valve according to claim 1, wherein said regenerator port has a first overall length along a circumferential direction of the face of said stationary seat;

said second-stage pulse tube port has a second overall length along a circumferential direction of the face of said stationary seat; and said first overall length is equal to or larger than said second overall length.

8. The rotary valve according to claim 1, wherein said pulse tube refrigerator is a single-stage pulse tube refrigerator having a single pulse tube.

9. The rotary valve according to claim 1, wherein, when the face of said rotary disk rotates relative to the face of said stationary seat, said first opening is moved to a position at which said first opening is brought into communication with said second-stage pulse tube port before being brought into communication with said first-stage pulse tube port, and/or said second opening is moved to a position at which said second opening is brought into communication with said second-stage pulse tube port before being brought into communication with said first-stage pulse tube port.

10. The rotary valve according to claim 1, wherein, when the face of said rotary disk rotates relative to the face of said stationary seat, a time period during which said first opening is in communication with said second-stage pulse tube port is longer than a time period during which said first opening is in communication with said first-stage pulse tube port, and/or a time period during which said second opening is in communication with said second-stage pulse tube port is longer than a time period during which said second opening is in communication with said first-stage pulse tube port.

11. The rotary valve according to claim 1, wherein said multivalve type pulse tube refrigerator includes a third-stage pulse tube, and a third-stage pulse tube port provided in the face of said stationary seat and connected to said third pulse tube so as to supply the high-pressure coolant to said third pulse tube and exhaust the low-pressure coolant from said third pulse tube.

12. The rotary valve according to claim 11, wherein said third-stage pulse tube port has a fifth overall length along a circumferential direction of the face of said stationary seat, and said fifth overall length is equal to or longer than said fourth overall length.

13. The rotary valve according to claim 11, wherein, when the face of said rotary disk rotates relative to the face of said stationary seat, said first opening is moved to a position at which said first opening is brought into communication with said third-stage pulse tube port before being brought into communication with said second-stage pulse tube port, and/or said second opening is moved to a position at which said second opening is brought into communication with said third-stage pulse tube port before being brought into communication with said second-stage pulse tube port.

14. The rotary valve according to claim 11, wherein, when the face of said rotary disk rotates relative to the face of said stationary seat, a time period during which said first opening is in communication with said third-stage pulse tube port is longer than a time period during which said first opening is in communication with said second-stage pulse tube port, and/or a time period during which said second opening is in communication with said third-stage pulse tube port is longer than a time period during which said second opening is in communication with said second-stage pulse tube port.

15. A multivalve type pulse tube refrigerator, comprising:

at least one pulse tube;

a regenerator; and a rotary valve according to claim 1.

16. The rotary valve according to claim 1, wherein a center of each of the regenerator ports and centers of said first-stage pulse tube port and said second-stage pulse tube port are arranged on an identical circle with respect to the center of the face of said stationary seat.

* * * * *